US006535168B1

(12) United States Patent
Marumoto et al.

(10) Patent No.: US 6,535,168 B1
(45) Date of Patent: Mar. 18, 2003

(54) PHASED ARRAY ANTENNA AND METHOD OF MANUFACTURING METHOD

(75) Inventors: Tsunehisa Marumoto, Tokyo (JP); Ryuichi Iwata, Tokyo (JP); Youichi Ara, Tokyo (JP); Hideki Kusamitu, Tokyo (JP); Kenichiro Suzuki, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/869,200

(22) PCT Filed: Nov. 22, 1999

(86) PCT No.: PCT/JP99/06514

§ 371 (c)(1),
(2), (4) Date: Oct. 12, 2001

(87) PCT Pub. No.: WO00/39891

PCT Pub. Date: Jul. 6, 2000

(30) Foreign Application Priority Data

Dec. 24, 1998 (JP) ..... 10-368067

(51) Int. Cl.[7] ..... H01Q 1/38

(52) U.S. Cl. ..... 343/700 MS; 343/767; 343/768; 343/778; 343/853

(58) Field of Search ..... 343/700 MS, 767, 343/768, 770, 771, 772, 774, 776, 777, 778, 853

(56) References Cited

U.S. PATENT DOCUMENTS 4,166,274 A * 8/1979 Reudink et al. ..... 342/376
4,851,855 A * 7/1989 Tsukamoto et al. .. 343/700 MS
4,904,831 A 2/1990 Nathanson et al. ..... 200/269
4,939,527 A * 7/1990 Lamberty et al. ..... 343/771
5,623,270 A * 4/1997 Kempkes et al. ..... 342/372
6,028,552 A * 2/2000 Shuguang ..... 342/372
6,232,920 B1 * 5/2001 Brookner et al. ..... 342/372
6,246,370 B1 * 6/2001 Wixforth ..... 343/700 MS
6,396,440 B1 * 5/2002 Chen ..... 343/700 MS

FOREIGN PATENT DOCUMENTS

| | | |
|---|---|---|
| CA | 2241375 | 12/1998 |
| JP | 53097752 | 8/1978 |
| JP | 1-290301 | 11/1989 |
| JP | 5-91016 | 12/1993 |
| JP | 6-267926 | 9/1994 |
| JP | 11-74717 | 3/1999 |

* cited by examiner

*Primary Examiner*—Don Wong
*Assistant Examiner*—Shih-Chao Chen
(74) *Attorney, Agent, or Firm*—Young & Thompson

(57) ABSTRACT

A relatively small and inexpensive phased array antenna provided even if the number of radiators is increased to enhance the gain. The phased array antenna has a multilayer structure including layers where a large number of radiators (15), phase-shifting units (17) each for shifting the phase of a high-frequency signal transmitted/received by the corresponding radiator, and a distributing/synthesizing unit (14) are provided respectively. The phase-shifting circuits (17A to 17D) constituting the phase-shifting units (17) are driven by the respective driver units (12). A switch (17S) used for the phase-shifting unit is provided together with the other wiring pattern on the layer where the phase-shifting units (17) are provided.

33 Claims, 17 Drawing Sheets

PHASED ARRAY ANTENNA AND METHOD OF MANUFACTURING METHOD

TECHNICAL FIELD

The present invention relates to a phased array antenna used for transmitting/receiving an RF signal such as a microwave to electrically adjust a beam radiation direction by controlling a phase supplied to each radiating element, and a method of manufacturing the antenna.

BACKGROUND ART

As a satellite tracking on-vehicle antenna or satellite borne antenna, a phased array antenna having many radiating elements arranged in an array has conventionally been proposed (see Technical Report AP90-75 of the Institute of Electronics, Information and Communication Engineers, and Japanese Patent Laid-Open No. 1-290301).

A phased array antenna of this type has a function of arbitrarily changing the beam direction by electronically changing the phase of a signal supplied to each radiating element.

As a means for changing the feed phase of each radiating element, a phase shifter is used.

As the phase shifter, a digital phase shifter (to be simply referred to as a phase shifter hereinafter) made up of a plurality of phase shift circuits having different fixed phase shift amounts is generally used.

The phase shift circuits are respectively ON/OFF-controlled by 1-bit digital control signals to combine the phase shift amounts of the phase shift circuits, thereby obtaining a feed phase of 0° to 360° by the whole phase shifter.

A conventional phased array antenna uses many components including semiconductor elements such as PIN diodes and GaAs FETs serving as phase shift circuits, and driver circuit components for driving the semiconductor elements.

The phase shifter applies a DC current or DC voltage to these switching elements to turn them on/off, and changes the transmission path length, susceptance, and reflection coefficient to generate a predetermined phase shift amount.

Recently in the field of low earth orbit satellite communications, communications at high data rates are required along with the wide use of the Internet and the spread of multimedia communications, and the gain of the antenna must be increased.

To implement communications at high data rates, the transmission bandwidth must be increased. Because of a shortage of the frequency resource in a low-frequency band, an antenna applicable to an RF band equal to or higher than the Ka band (about 20 GHz or higher) must be implemented.

More specifically, an antenna for a low earth orbit satellite tracking terminal (terrestrial station) must satisfy technical performance:

Frequency: 30 GHz

Antenna gain: 36 dBi

Beam scanning range: beam tilt angle of 50° from front direction

To realize this by a phased array antenna, first, the aperture area: about 0.13 $m^2$ (360 mm×360 mm) is needed.

In addition, to suppress the side lobe, radiating elements must be arranged at an interval of about ½ wavelength (around 5 mm for 30 GHz) to avoid generation of the grating lobe.

To set a small beam scanning step and minimize the side lobe degradation caused by the quantization error of the digital phase shifter, the phase shift circuit used for the phase shifter is desirably made up of at least 4 bits (22.5° for the minimum-bit phase shifter).

The total number of radiating elements and the number of phase shift circuit bits used for a phased array antenna which satisfies the above conditions are given by Number of elements for the phase shift circuit: 72×72=about 5,000

Number of phase shift circuit bits: 72×72×4=about 20,000 bits

When a high-gain phased array antenna applicable to an RF band is to be implemented by, e.g., a phased array antenna disclosed in Japanese Patent Laid-Open No. 1-290301 shown in FIG. 18, the following problems occur.

That is, in such a conventional phased array antenna, switching elements serving as discrete components are individually mounted on a substrate formed with wiring patterns, thereby forming a phase shifter, as shown in FIG. 18.

However, a gain is determined depending on the area of a phased array antenna, and its arrangement interval is determined depending on the frequency band in which the antennas are to be used, as described above. Accordingly, if a high-gain phased array antenna used in a higher RF band is formed, the number of phase shifters greatly increases in accordance with a large increase in number of radiating elements, thereby greatly increasing the number of mounted components.

This increases a time required for mounting these components on the substrate and the manufacturing lead time, thereby increasing manufacturing cost.

The present invention has been made to solve the above problems, and has as its object to provide a high-gain phased array antenna applicable to an RF band.

DISCLOSURE OF INVENTION

To achieve the above object, in a phased array antenna according to the present invention, radiating elements and phase shifters are individually formed on a radiating element layer and phase control layer, respectively, and both layers are coupled by a first coupling layer to form a multilayered structure as a whole. A distribution/synthesis unit is formed on a distribution/synthesis layer, and the phase control layer and distribution/synthesis layer are coupled by a second coupling layer to form the multilayered structure as a whole. Therefore, the radiating elements and distribution/synthesis unit are eliminated from the phase control layer, thereby reducing an area in the phase control layer which is to be occupied by the radiating element and distribution/synthesis unit.

The phase control layer further has a multilayered structure in which a plurality of control signal lines for controlling the phase shifters are formed on different layers in the phase control layer. This reduces an area, which is to be occupied by the control signal lines, on the layer on which the phase shifters are formed.

The phase control layer uses a micromachine switch as an RF switch included in the phase shifter, and a number of micromachine switches are simultaneously formed by a semiconductor device manufacturing process. This can make the entire phase shifter small.

For this reason, the area of the phase control layer which defines the area of the radiating element layer can be reduced, many radiating elements are arranged, in units of several thousands, at an interval (around 5 mm) which is optimal for an RF signal of, e.g., about 30 GHz. This can implement a high-gain phased array antenna applicable to an RF band.

In addition, the switches used in each phase shifter are simultaneously formed on a phase control layer (a single substrate). Therefore, as compared to a case wherein the circuit components are individually mounted as in the prior art, the numbers of mounting components, the numbers of connections, and the numbers of assembling processes can decrease, thereby reducing the manufacturing cost of the whole phased array antenna.

Further, since a driver unit simultaneously switches the control signals output to the phase shift circuits, the phase amounts of the radiating elements set in the phase shifters are simultaneously changed, thereby instantaneously changing a radiation beam direction.

Furthermore, since the driver unit for controlling the phase shifter is comprised of a flip chip which can be formed in a small area, no space in which the driver unit is to be arranged is required, thereby forming a relatively small phased array antenna.

BEST MODE OF CARRYING OUT THE INVENTION

The present invention will be described below with reference to the accompanying drawings.

Figure 1:
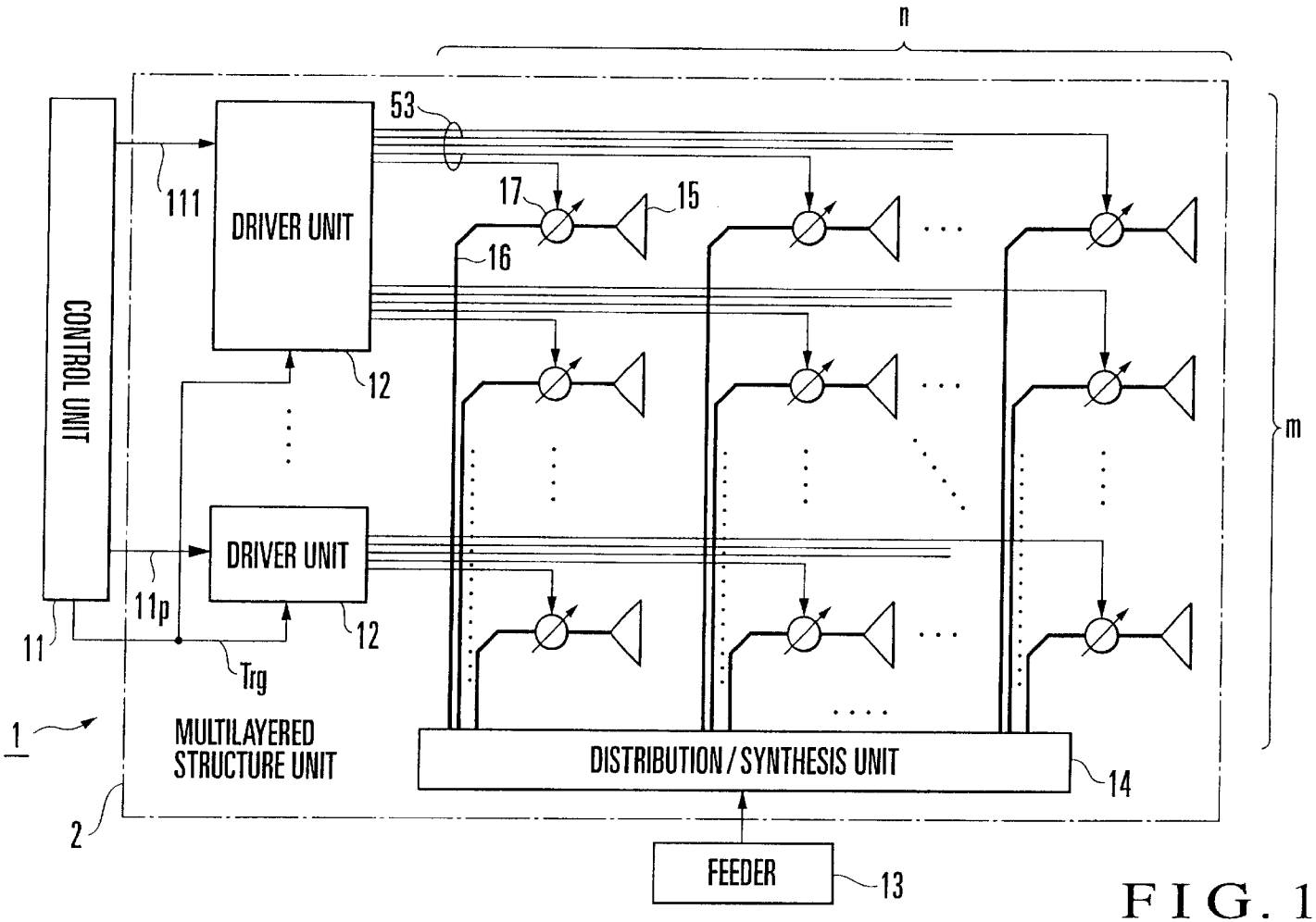
FIG. 1 is a block diagram of a phased array antenna according to an embodiment of the present invention.

FIG. 1 is a block diagram of a phased array antenna 1 according to an embodiment of the present invention.

In the following description, a phased array antenna is used as an RF signal transmission antenna. However, the phased array antenna is not limited to this, and can be used as an RF signal reception antenna for the same operation principle based on the reciprocity theorem.

In addition, when a whole antenna is made up of a plurality of subarrays, the present invention may be applied to a phased array antenna of each subarray.

FIG. 1 is a view for explaining the arrangement of the phased array antenna 1. Referring to FIG. 1, the phased array antenna 1 is made up of a multilayered substrate unit 2 on which antenna radiating elements, phase control circuits, and the like are mounted on a multilayered substrate, a feeder 13 for feeding RF power to the multilayered substrate unit 2, a control unit 11 for controlling the phase of each radiating element of the multilayered substrate unit 2, and a driver unit 12 for individually driving phase shifters.

In FIG. 1, m×n (m and n are integers of 2 or more) radiating elements 15 are arranged in an array, and RF signals are supplied to the radiating elements 15 from the feeder 13 via a distribution/synthesis unit 14, strip lines 16, and phase shifters 17.

Note that, the radiating elements 15 may be arranged in a rectangular matrix shape or any other shape such as a triangular shape.

Many control signal lines 53 (in the aforementioned example, the total number of phase shifters 17 is about 5,000 units) for connecting the phase shifters 17 to the phase shift units 16 and the active regions 12 to the phase shifters 17 are simultaneously formed on the phased array antenna 1 by photolithography and etching.

The control unit 11 calculates the feed phase shift amount of each radiating element 15 on the basis of a desired beam radiation direction.

The calculated phase shift amounts of respective calculated radiating elements 15 are distributed from the control unit 11 to the p driver units 12 by control signals 11*i* to 11*p* (one of these control signals may be called as a control signal 11*i*). In one driver unit 12, the phase shift amounts of the q radiating elements 17 are serially input. In this case, p×q is basically equal to the total number of m×n radiation elements, but becomes slightly larger than the number of total radiation elements depending on the number of output terminals of the driver units 12.

Figure 2:
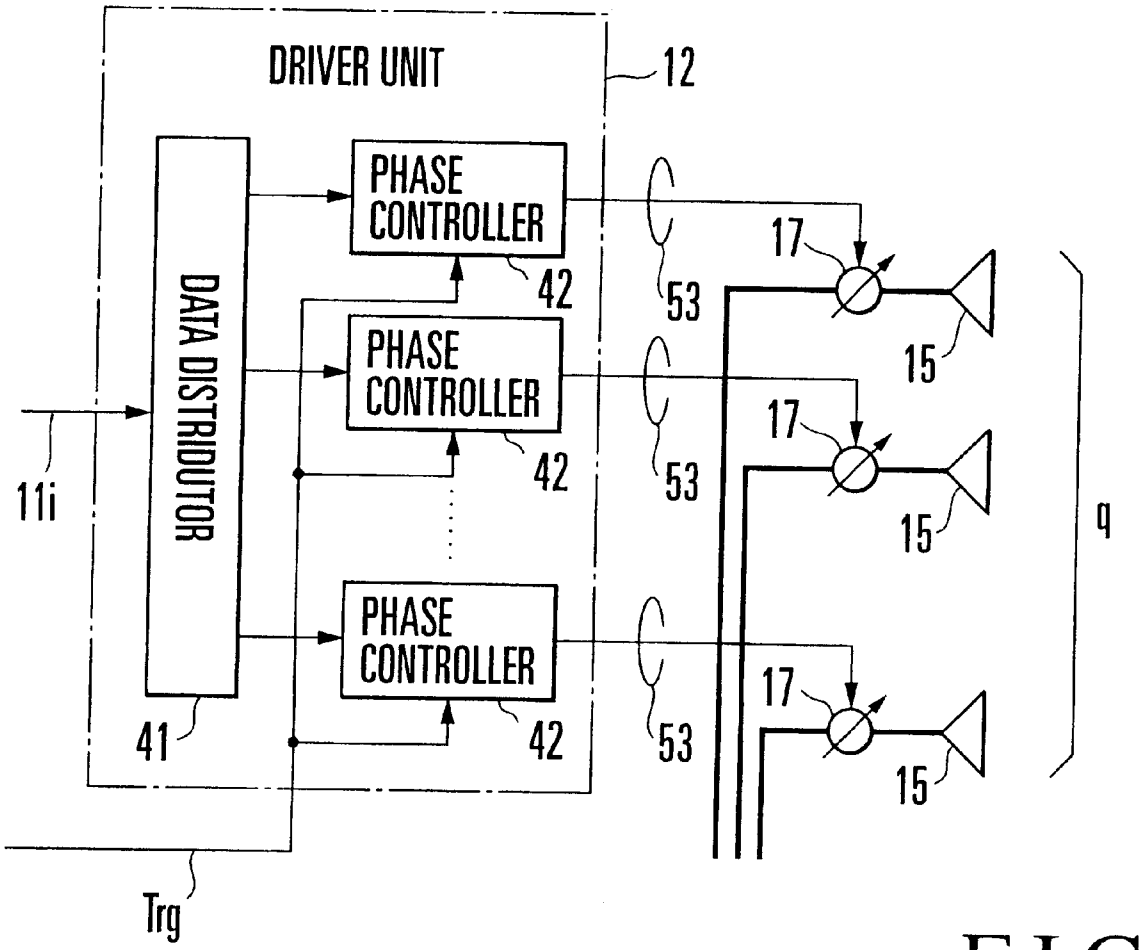
FIG. 2 is a block diagram of a driver unit.

FIG. 2 is a block diagram of the driver unit 12.

The driver unit 12 is comprised of a data distributor 41 and q phase controllers 42 arranged for the respective phase shifters 17.

The driver unit 12 serially receives the phase shift amounts of the q radiating elements 15.

The data distributor 41 distributes the phase shift amounts of the q radiating element 15 included in a control signal 11*i* to the q phase controllers 42 respectively connected to the phase shifters 17.

Then, the phase shift amounts of the radiating elements 15 are set in corresponding phase controllers 42.

As shown in FIG. 1, the control unit 11 outputs a trigger signal Trg to each driver unit 12.

The trigger signal Trg is input to each phase controller 42 of the driver unit 12, as shown in FIG. 2.

The trigger signal Trg determines a timing in which each phase shift amount set in the phase controller 42 is designated and output to a corresponding phase shifter 17.

Therefore, after the phase shift amounts are respectively set in the phase controllers 42, the controller 11 outputs the pulse-like trigger signal Trg to simultaneously update the feed phase shift amounts to the respective radiating elements 15, thereby instantaneously changing the beam radiation direction.

The phase shifter 17 arranged for each radiating element 15 and the phase controller 42 of the driver unit 12 will be described with reference to FIG. 3.

Figure 3:
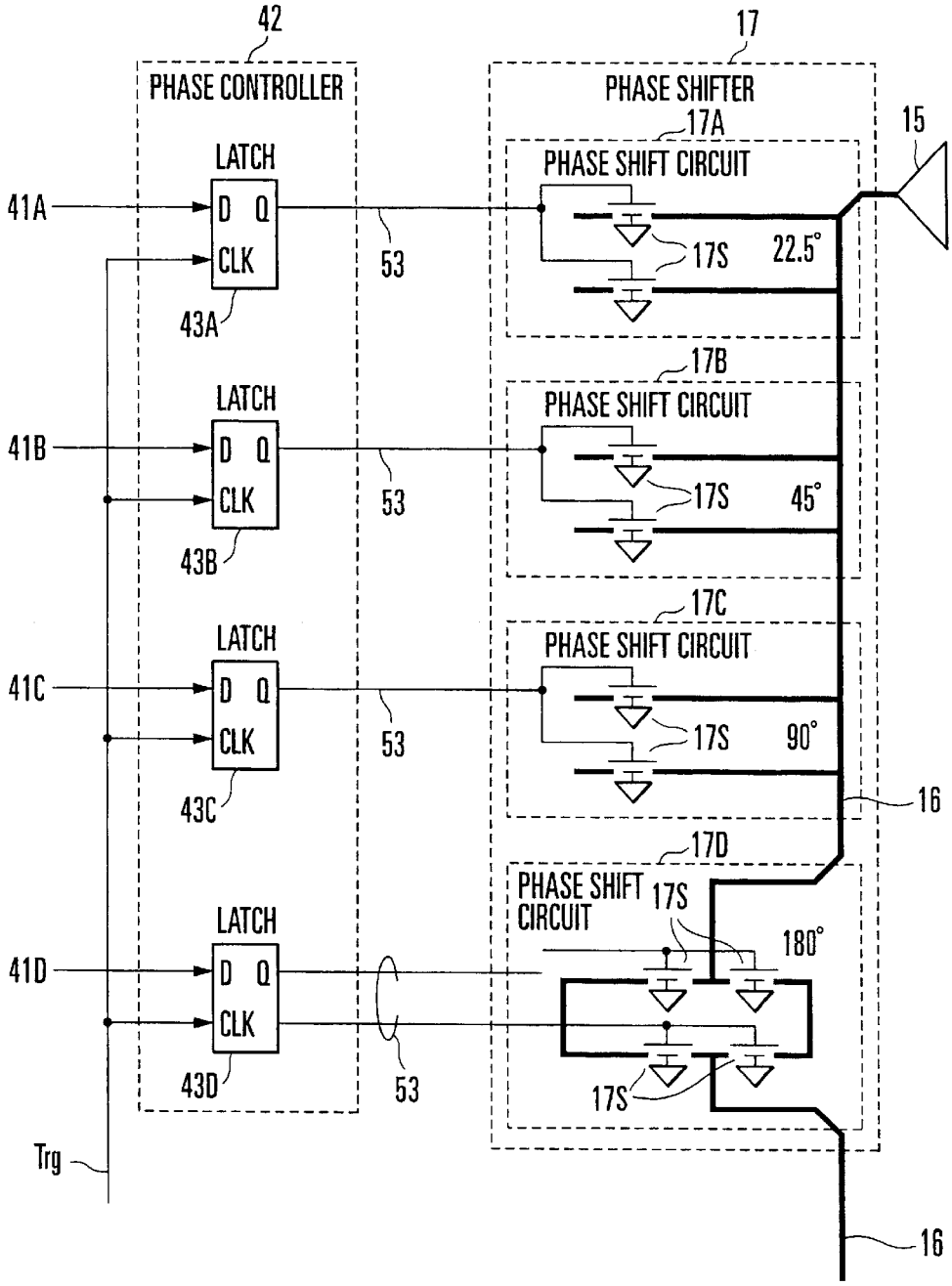
FIG. 3 is a block diagram of a phase shifter and a phase controller.

FIG. 3 is a block diagram showing the phase shifter 17 and the phase controller 42.

In this case, the phase shifter 17 is made up of four phase shift circuits 17A to 17D having different phase shift amounts of 22.5°, 45°, 90°, and 180°.

The phase shift circuits 17A to 17D are connected to a strip line 16 for propagating an RF signal from the distribution/synthesis unit 14 to the radiating element 15.

In particular, each of the phase shift circuits 17A to 17D comprises a switch 17S.

By switching the internal switches of the switch 17S, a predetermined feed phase shift amount (to be described below) is supplied.

The phase controller 42 for individually controlling the switches 17S of the respective phase shift circuits 17A to 17D is constituted by latches 43A to 43D respectively arranged for the phase shift circuits 17A to 17D.

The data distributor 41 of the driver unit 12 outputs control signals 41A to 41D to the latches 43A to 43D which constitute the phase controller 42 to give the phase controller 42 the phase shift amount of the radiating element 15.

Therefore, the inputs D of the latches 43A to 43D receive the control signals 41A to 41D, respectively.

The inputs CLK of the latches 43A to 43D receive the trigger signal Trg output from the control unit 11.

The latches 43A to 43D latch the control signals 41A to 41D at the leading (or trailing) edge of the trigger signal Trg, and output the outputs Q to the switches 17S of the corresponding phase shift circuits 17A to 17D.

The ON/OFF states of the switches 17S of the phase shift circuits 17A to 17D are determined in accordance with the states of the latched control signals 41A to 41D.

In this fashion, the phase shift amounts of the phase shift circuits 17A to 17D are set to set the total phase shift amount of the phase shifter 17. Accordingly, a predetermined feed phase shift amount is given to an RF signal propagating through the strip line 16.

Note that the switches 17S may be sequentially switched by always outputting the trigger signal Trg, i.e., always keeping the trigger signal Trg at high level (or low level). In this case, the entire phase shifter 17 is not simultaneously switched but is partially switched, which avoids a hit of a radiation beam.

If the output voltages or currents of the latches 43A to 43D are not high enough to drive the switches 17S, voltage amplifiers or current amplifiers may be arranged on the output sides of the latches 43A to 43D.

The substrate arrangement of the phased array antenna according to this embodiment will be described next with reference to FIG. 4.

Figure 4:
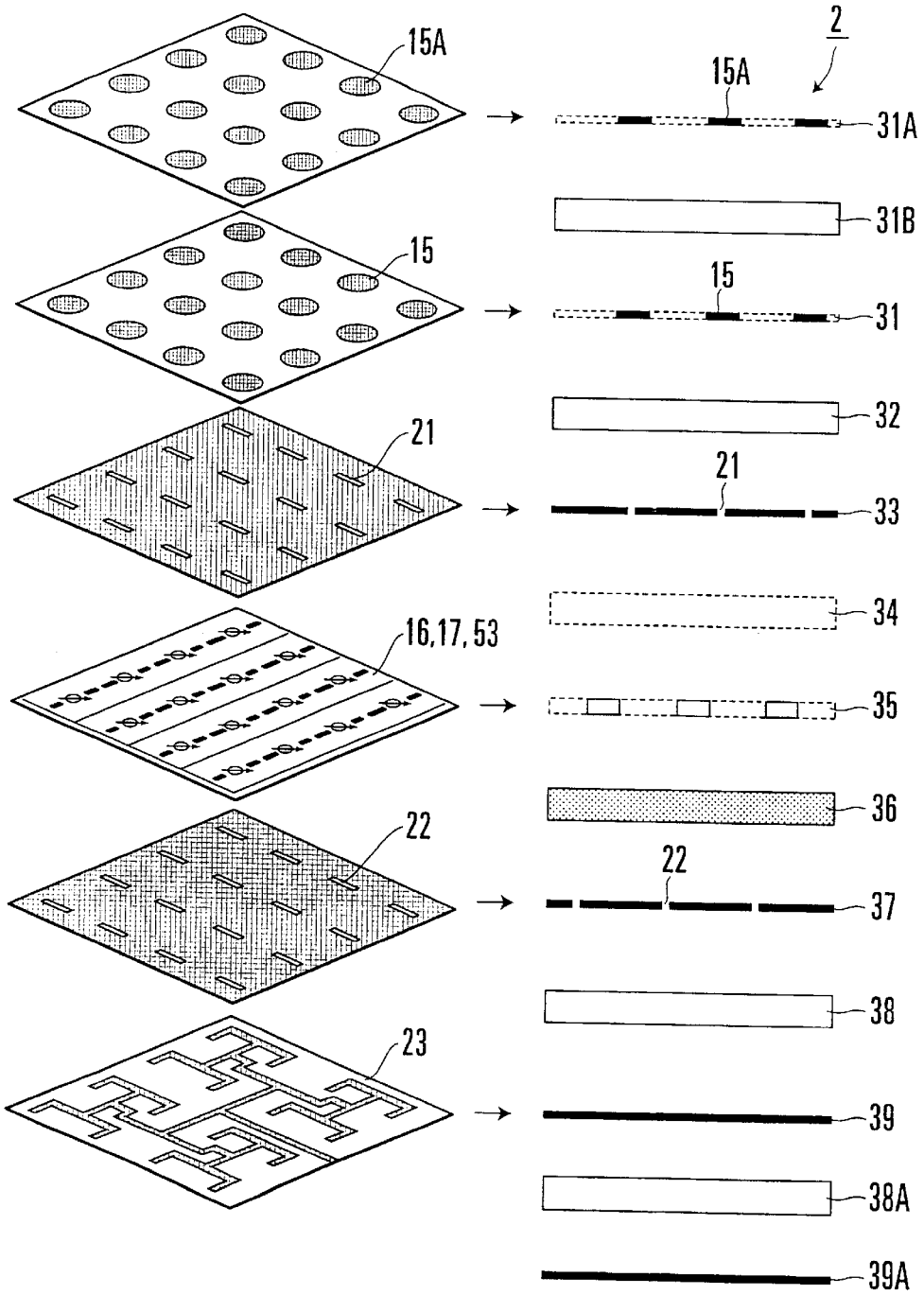
FIG. 4 is a view for explaining a multilayered substrate structure.

FIG. 4 is a view for explaining the multilayered substrate unit 2, which shows perspective views of layers and schematic views of sections.

The layers are patterned by photolithography, etching, or printing and stacked and integrated into a multilayer.

The stacking order of the respective layers is not necessarily limited to the one shown in FIG. 4. Even if the stacking order partially changes due to deletion or addition depending on the electrical/mechanical requirement, the present invention is effective.

A branch-like strip line 23 for distributing RF signals applied from the feeder 13 is formed on a distribution/synthesis layer 39.

The strip lines 23 can use a tournament scheme in which two branches are repeated or a series distribution scheme for gradually branching the main line in comb-like teeth.

A dielectric layer 38A and a ground layer 39A made of a conductor are added outside the distribution/synthesis layer 39 in accordance with a mechanical design condition such a mechanical strength or an electrical design condition such as unnecessary radiation suppression.

A coupling layer 37 (second coupling layer) is formed above the distribution/synthesis layer 39 through a dielectric layer 38.

The coupling layer 37 is comprised of a conductive pattern in which holes, i.e., coupling slots 22 are formed on a ground plane.

A phase control layer 35 is formed above the coupling layer 37 through a dielectric layer 36.

The strip line 16, the phase shifters 17, and the control signal lines 53 for connecting the phase shifters 17 to the driver units 12 are formed on the phase control layer 35, and a large number of them (the total number of phase shifters 17 is about 5,000 in the example as described above) are simultaneously formed by photolithography or etching.

A coupling layer 33 (first coupling layer) having coupling slots 21 as in the coupling layer 37 is formed above the phase control layer 35 through a dielectric layer 34.

A radiating element layer 31 having the radiating elements 15 is formed above the coupling layer 33 through a dielectric layer 32.

A passive element layer 31A having passive elements 15A is formed above the radiating element layer 31 through a dielectric layer 31B.

However, the passive elements 15A are added to widen the band, and may be arranged as needed.

Each of the dielectric layers 31B, 32, 38, and 38A is made of a material having low relative dielectric constant of about 1 to 4, e.g., a printed board, glass substrate, or foaming material. These dielectric layers may be spaces (air layers).

As the dielectric layer 36, a semiconductor substrate (silicon, gallium arsenide, or the like) as well as a glass substrate can be used. Alternatively, a circuit board such as a ceramics board or a printed board may be used.

In particular, since the switches of the phase shifter 17 are simultaneously formed on the phase control layer 35 as described above, the dielectric layer 34 may be made of a space (air layer).

For the sake of descriptive simplicity, the respective layers constructing the multilayered substrate portion 2 are separately described in FIG. 4. However, a layer adjacent to each of the dielectric layers 31B, 32, 34, 36, 38, and 38A, e.g., the radiating element layer 31 or dielectric layer 32 is realized by patterning it on one or two sides of the dielectric layer.

The aforementioned dielectric layer is not made of a single material and may have an arrangement in which a plurality of materials are stacked.

In the antenna having the multilayered structure described above, the RF signal from the feeder 13 (not shown in FIG. 4) propagates from the strip line 23 of the distribution/synthesis layer 39 to the strip lines of the phase control layer 35 via the coupling slots 22 of the coupling layer 37.

The RF signal is then given a predetermined feed phase shift amount in the phase shifter 17 and propagates to the radiating elements 15 of the radiating element layer 31 via the coupling slots 21 of the coupling layer 33 to radiate from each radiating element 15 to a predetermined beam direction.

In this manner, in the present invention, the radiating elements 15 and the phase shifters 17 are individually formed on the radiating element layer 31 and the phase control layer 35, respectively, and both layers are coupled by the coupling layer 33 to form the multilayered structure as a whole.

In addition, the distribution/synthesis unit 14 is individually formed on the distribution/synthesis layer 39, and the phase control layer 35 and distribution/synthesis layer 39 are coupled by the coupling layer 37 to form the multilayered structure as a whole.

This reduces the area, of the phase control layer 35, which is to be occupied by the radiating elements 15 and distribution/synthesis unit 14 even if the number of radiating elements 15 increases in order to improve the gain.

Accordingly, one phase shifter 17 is formed in a relatively small area. For this reason, e.g., for the RF signal of about 30 GHz, the radiating elements 15 can be arranged at an optimum interval of around 5 mm, thereby realizing the high-gain phased array antenna applicable to an RF band.

In addition, an angle in which the grating lobe is generated is made large by realizing the optimum element interval, thereby scanning a beam within a wide range centered on the front direction of the antenna.

In the phase control layer 35, the switches 17S used in the phase shift circuits 17A to 17D are simultaneously formed together with the wiring patterns (i.e., the first strip line 16, second strip line, and control signal lines 53) of the phase control layer 35. Thus, as compared to the case in which the circuit components are individually mounted as in the prior art, the number of separately mounted components, the number of connections, and the number of assembling processes can be decreased, thereby reducing the manufacturing cost of the whole phased array antenna.

As each strip line 16 used in the present invention and the strip line used in each phase shifter 17, a triplet type, coplanar type, slot type, or the like as well as a microstrip type distributed constant line can be used.

As the radiating element 15, a printed dipole antenna, slot antenna, aperture element or the like as well as a patch antenna can be used.

In particular, the opening of the coupling slot 21 of the coupling layer 33 is made large, which is usable as a slot antenna. In this case, the coupling layer 33 also serves as the radiating element layer 31, and the radiating element layer 31 and passive element layer 31A can be omitted.

In place of the coupling slots 21, conductive feed pins for connecting the strip lines 16 of the phase control layer 35 and the radiating elements 15 may be used to couple the RF signals.

Further, in place of the coupling slots 22, conductive feed pins projecting from the strip lines of the phase control layer 35 to the dielectric layer 38 through holes formed in the coupling layer 37 may be used to couple the RF signals.

The same function as that of the distribution/synthesis layer 39 can also be realized even if a radial waveguide is used.

Figure 5:
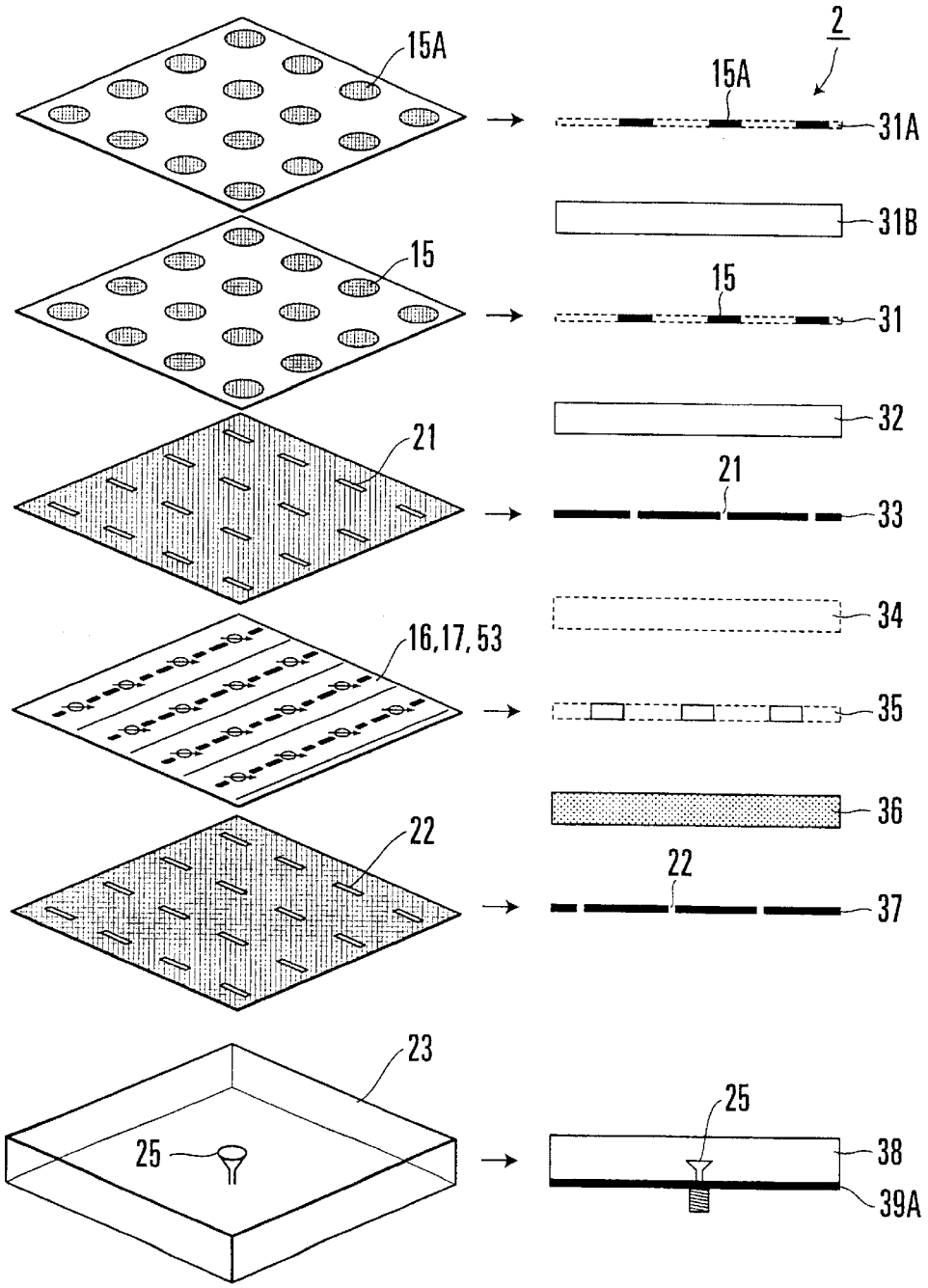
FIG. 5 is a view showing a multilayered substrate structure according to another embodiment of the present invention.

FIG. 5 is a view for explaining the arrangement of the present invention when using the radial waveguide.

In this case, a distribution/synthesis function is realized by a dielectric layer 38, ground layer 39A, and probe 25 of a multilayered substrate unit 2 shown in FIG. 5, and a distribution/synthesis layer 39 required in FIG. 4 can be omitted.

In this case, the dielectric layer 38 is also made of a printed board, glass substrate, foaming agent, or space (air layer). As the ground layer 39A, the copper foil on a printed board may be directly used, or a metal plate or a metal enclosure for enclosing all the side surfaces of the dielectric 38 may be separately arranged.

The present invention can also be applied to a space-fed phased array antenna.

Figure 6:
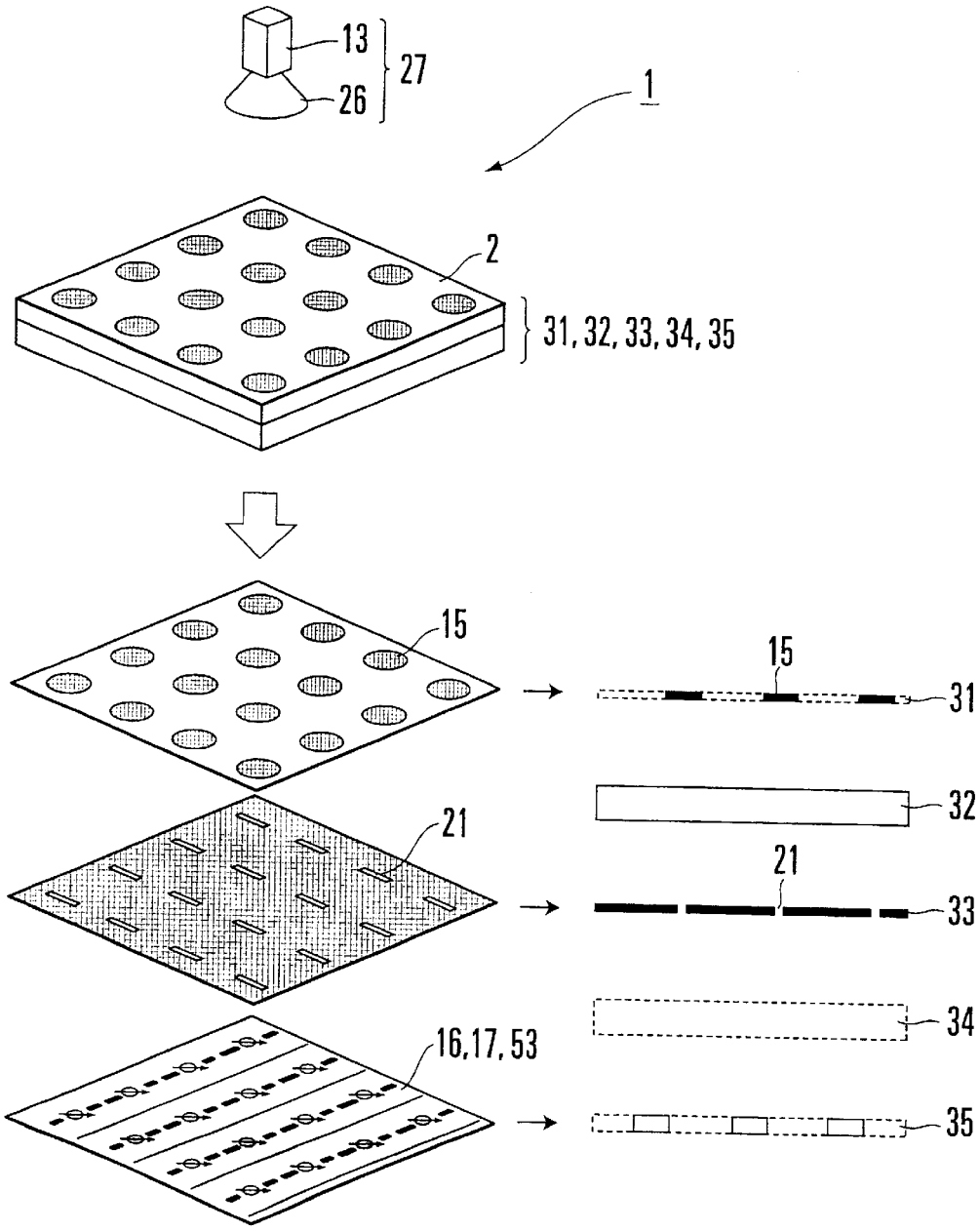
FIG. 6 is a view showing a multilayered substrate structure according to still another embodiment of the present invention.

FIG. 6 shows the arrangement of a reflection-type space-fed phased array antenna as an example.

A phased array antenna 1 shown in FIG. 6 is made up of a feeder 13, a radiation feeder 27 having a primary radiation unit 26, a multilayered substrate unit 2, and a control unit 11 (not shown). In this structure, the multilayered substrate unit 2 has a structure different from that shown in FIG. 4, which is constructed by a radiating element layer 31, dielectric layer 32, coupling layer 33, dielectric layer 34, and phase control layer 35.

The function of the distribution/synthesis unit 14 shown in FIG. 1 is realized by the primary radiation unit 26 so that a distribution/synthesis layer 39 is excluded from the multilayered substrate unit 2.

In the phased array antenna 1, an RF signal radiated from the radiation feeder 27 is temporarily received by each radiating element 15 on the radiating element layer 31, and is coupled to each phase shifter 17 on the phase control layer 35 via the coupling layer 33. After the phase of the RF signal is controlled by each phase shifter 17, the RF signal propagates to each radiating element 15 again via the coupling layer 33, and radiates from each radiating element 15 in the predetermined beam direction.

The present invention is effective even for the space-fed phased array antenna as described above which includes no distribution/synthesis layer 39 in the multilayered substrate unit 2.

An example of the arrangement of the phase control layer 35 will be explained next with reference to FIG. 7.

Figure 7:
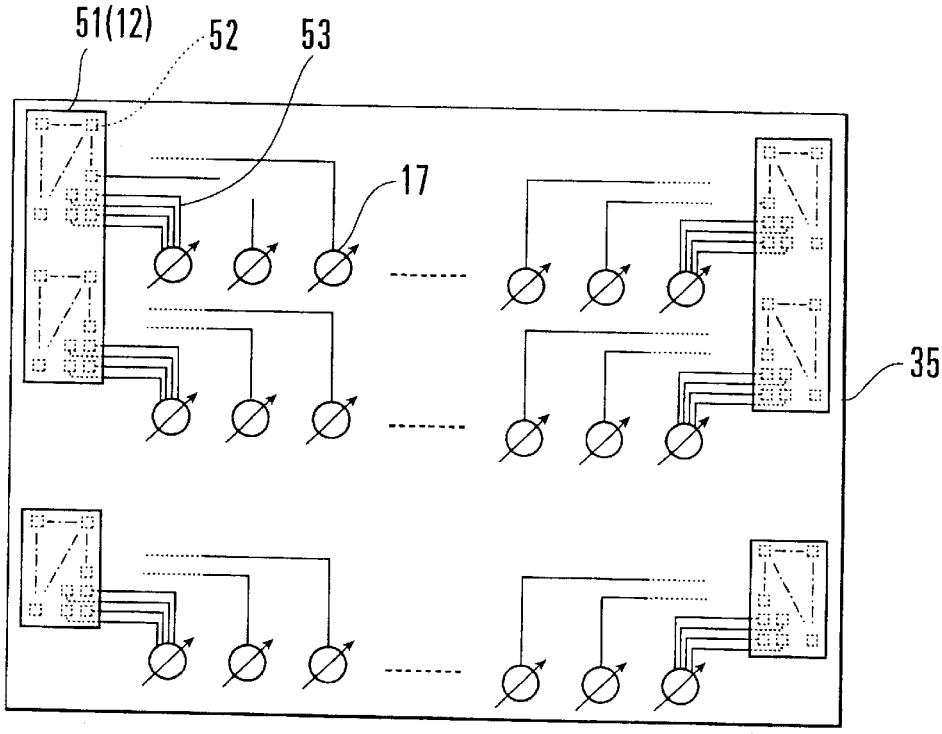
FIG. 7 is an explanatory view schematically showing the arrangement on a phase control layer.

FIG. 7 is an explanatory view schematically showing an arrangement on the phase control layer 35.

In a multilayered structure region on the phase control layer 35, many phase shifters 17 are arranged in an array, and the wiring patterns of the control signal lines 53 are formed.

The plurality of driver units 12 each made up of a flip chip 51 are arranged in a region on the phase control layer 35 except for the multilayered structure region.

The flip chip 51 is a chip for bonding by using a connection terminal formed on a chip or board (i.e., for face-down bonding) without any lead wire such as a wire lead or a beam lead.

If the flip chip 51 is mounted by a bump scheme, bumps 52 are formed on the chip electrodes as connection terminals to connect to the wiring lines of the phase control layer 35 directory or through an anisotropy conductive sheet.

If the driver unit 12 is made up of the flip chip 51, the bumps 52 are formed on the input electrodes of the data distributor 11*i*, the common electrode of the inputs CLK of latches 43 which constitute each phase controller 42, and the electrodes of the outputs Q of the latches 43.

In particular, the bumps 52 serving as the outputs Q of the latches 43 are individually connected to one of the phase shift circuits 17A to 17D of the phase shifter 17 by the control signal lines 53 formed on the phase control layer 35.

Since the bumps 52 are formed not only around the chip but also on the entire surface of the chip, the chip size does not always increase even if the number of electrodes increases, thereby increase the packaging density of the IC.

For this purpose, even if, an increase in number of the radiating elements 15 increases the total number of bits of the phase shifter 17 to be controlled in order to improve the gain of an antenna, the driver unit 12 for driving the phase shifter 17 is comprised of the flip chip 51, thereby suppressing an increase in size of the phased array antenna.

In addition, since the number of chips mounted on the phase control layer 35 can be decreased, a time required for arranging the chips at predetermined positions can be reduced, thereby suppressing an increase in manufacturing lead time.

Assume that, an example, in arranging the phased array antenna, the number of radiating elements 15 is set at 5,000 to obtain the gain of 36 dBi, and each phase shift circuit used in each phase shifter 17 is made up of 4 bits to obtain many beam scanning steps. In this case, total number of phase shift circuit bits is 20,000.

In this case, the chips corresponding to the 20,000 terminals are required for constructing the driver units 12. However, all the phase shifters 17 can be driven by using the ten flip chips 51 each having 2,000 terminals.

The flip chips 51 are arranged on the two sides of the phase control layer 35 in the column direction.

The flip chips 51 on the left side control the left half of the phase shifters 17 arranged in the row direction while the flip chips 51 on the right side control the right half of the phase shifters 17 arranged in the row direction.

The phase control layer 35 has a two-layered structure, and the control signal line 53 for connecting the bumps 52 of the flip chip 51 to the respective phase shift circuits 17A to 17D are separately wired on the two layers of the phase control layer 35.

The control signal lines 53 formed on a layer different from the flip chips 51 or the phase shift circuits 17A to 17D are connected to the flip chips 51 or the phase shift circuits 17A to 17D through via holes (electrical connecting holes) formed in a board.

With this structure, the maximum width of the bundle of the control signal lines 53 (see FIGS. 13 to 17) is made small, thereby reducing the area of the phase control layer 35 which is to be prepared for the control signal lines 53.

This makes the phased array antenna small and decreases the intervals between the radiating elements 15, thereby increasing the radiation beam range.

If the number of control signal lines 53 is small, or the width of each control signal line 53 is made small, the phase control layer 35 is not required to have the multilayered structure, and all the control signal lines 53 can be wired on the single layer.

In this example, the flip chip 51 in the bump scheme has been explained. However, bumps may be formed on a board on which the flip chips 51 is to be mounted (the phase control layer 35 in this case) in place of forming the bumps 52 on the chip, and the flip chips 51 are mounted as in the manner described above.

A structure of the switch 17S will be described with reference to FIG. 8 while using an example of practical sizes.

Figure 8:
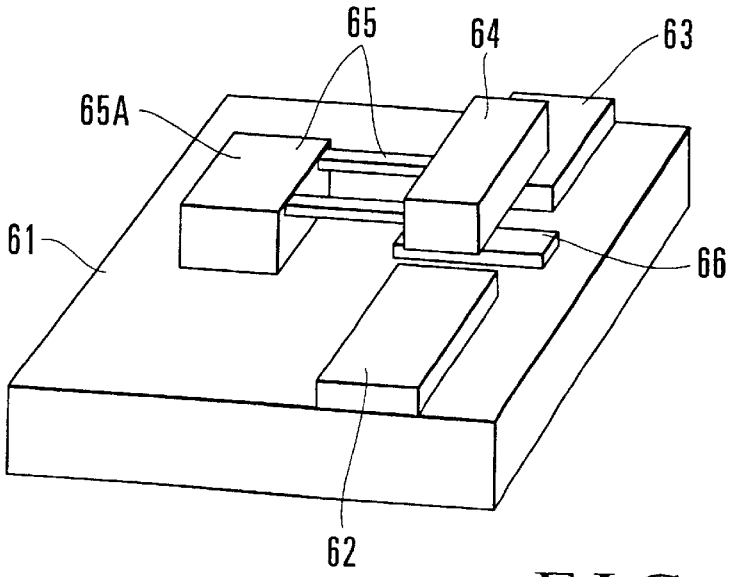
FIG. 8 is a perspective view showing a structure of a switch.
Figure 9A:
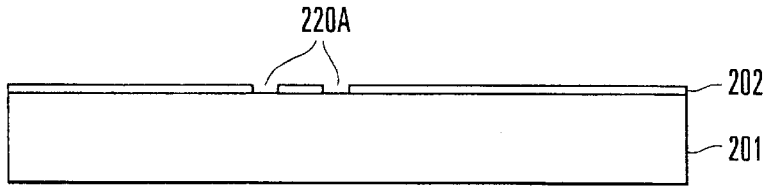
FIG. 9 is the first view showing a process for simultaneously forming micromachine switches on the phase control layer.
Figure 9B:
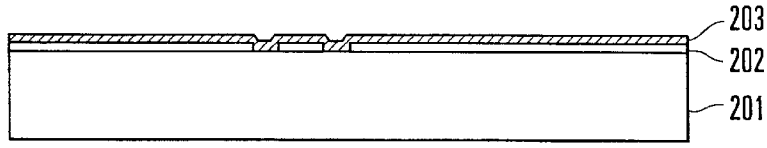
Figure 9C:
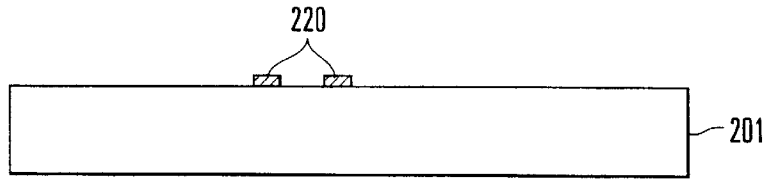
Figure 9D:
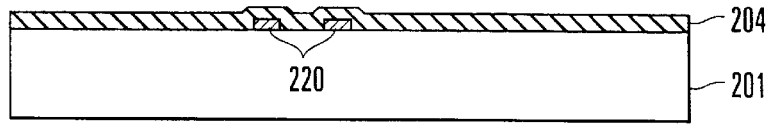
Figure 9E:
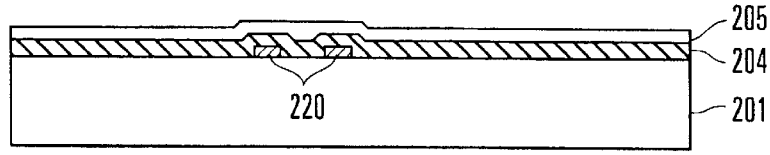
Figure 9F:
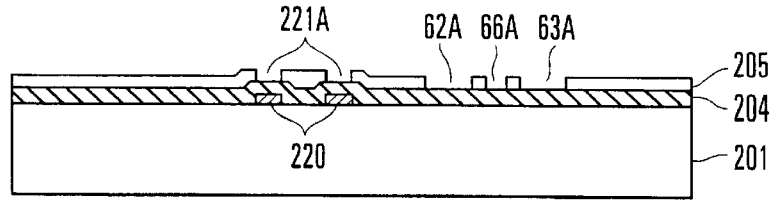
Figure 10G:
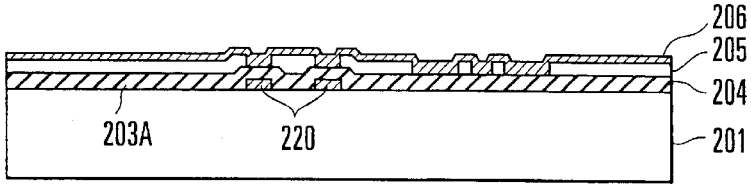
FIG. 10 is the second view showing the process for simultaneously forming the micromachine switches on the phase control layer.
Figure 10H:
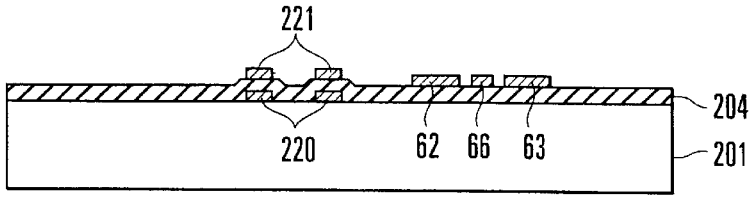
Figure 10I:
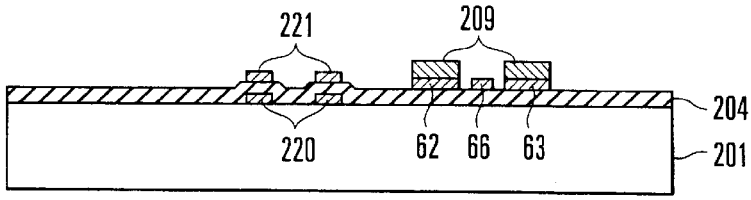
Figure 10J:
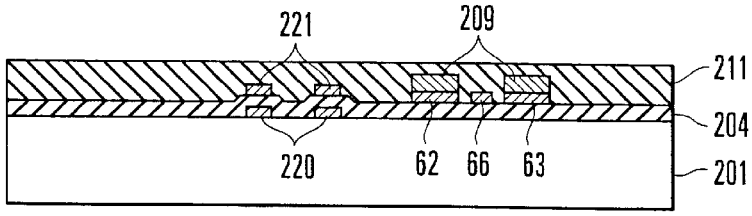
Figure 10H:
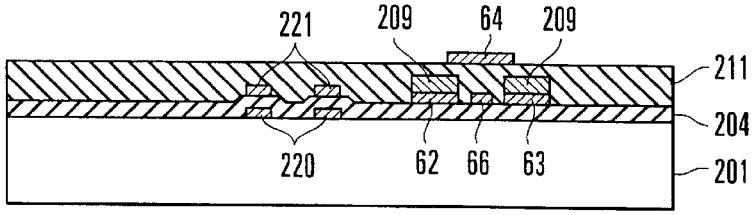
Figure 10L:
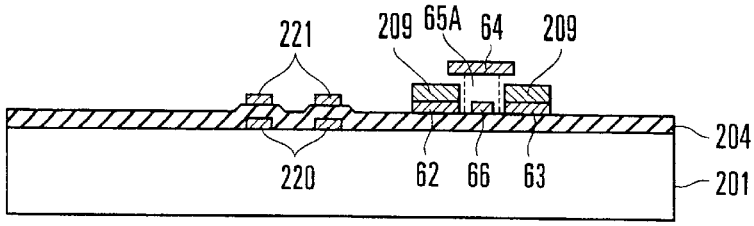

FIG. 8 is a perspective view showing the structure of the switch.

This switch 17S is comprised of a micromachine switch for short-circuiting/releasing strip lines 62 and 63 by a contact (small contact) 64. The "micromachine switch" means a small switch suitable for integration by a semiconductor device manufacturing process.

The strip lines 62 and 63 (about 1 $\mu$m thick) are formed on a substrate 61 at a small gap. The contact 64 (about 2 $\mu$m thick) is supported by a support member 65 above the gap so as to freely contact the strip lines 62 and 63. The distance between the lower surface of the small contact 64 and the upper surfaces of the strip lines 62 and 63 is about 4 $\mu$m. The level of the upper surface of the small contact 64 from the upper surface of the substrate 61, i.e., the height of the whole micromachine switch is about 7 $\mu$m.

A conductive electrode 66 (about 0.2 $\mu$m thick) is formed at the gap between the strip lines 62 and 63 on the substrate 61. The height (thickness) of the electrode 66 is smaller than that of the strip lines 62 and 63.

The operation of the switch will be explained.

The electrode 66 receives an output voltage (e.g., about 10 to 100 V) from a corresponding one of the driver circuits 19A to 19D.

When a positive output voltage is applied to the electrode 66, positive charges are generated on the surface of the electrode 66. At the same time, negative charges appear on the surface of the facing contact 64 (to be referred to as a lower surface hereinafter) by electrostatic induction, and are attracted to the strip lines 62 and 63 by the attraction force between the Since the contact 64 is longer than the gap between the strip lines 62 and 63, the contact 64 contacts both the strip lines 62 and 63, and the strip lines 62 and 63 are electrically connected in a high-frequency manner through the contact 64.

When application of the output voltage to the electrode 66 stops, the attraction force disappears, and the contact 64 returns to an original apart position by the support member 65 to release the strip lines 62 and 63.

In the above description, the output voltage is applied to the electrode 66 without applying any voltage to the contact 64. However, the operation may be reversed.

That is, the output voltage of the driver circuit may be applied to the contact 64 via the conductive support member 65 without applying any voltage to the electrode 66. Even in this case, the same effects as those described above can be attained.

At least the lower surface of the contact 64 may be formed from a conductor so as to ohmic-contact the strip lines 62 and 63. Alternatively, an insulating thin film may be formed on the lower surface of the conductive member so as to capacitively couple the strip lines 62 and 63.

In the micromachine switch, the contact 64 is movable. When the phase control layer 35 is formed on a multilayered substrate, like a phased array antenna, a space for freely moving the contact 64 must be defined.

In this manner, since the micromachine switch is used as the switching element for controlling the feed phase, the power consumption at the semiconductor junction can be eliminated as compared with the use of a semiconductor device such as a PIN diode. This makes it possible to reduce the power consumption to about 1/10.

A formation means of circuit components of the phase shifter 17 incorporated in the phase control layer 35, the strip line 16, and the control signal line 53 will be described next.

FIGS. 9 and 10 show a case in which the control signal lines 53 (corresponding to wiring lines 220 and 221) and the switch 17S (micromachine switch in this case) are simultaneously formed by applying a semiconductor element manufacturing process, and particularly, by applying a wiring means by a thin film as an example of the means for forming a circuit component.

First, a glass substrate 201 whose surface is accurately polished to have flatness Ra=about 4 to 5 nm is prepared, and a photoresist is applied onto the glass substrate 201.

The glass substrate 201 is patterned by known photolithography, and a resist pattern 202 having grooves 220A at predetermined portions is formed on the glass substrate 201, as shown in FIG. 9(*a*).

As shown in FIG. 9(*b*), a metal film 203 made of chromium, aluminum or the like is formed on the resist pattern 202 having the grooves 202A by sputtering.

The resist pattern 202 is removed by a method, e.g., dissolving it in an organic solvent to selectively remove (lift off) the metal film 203 on the resist pattern 202, thereby forming the wiring patterns 220 on the glass substrate 201, as shown in FIG. 9(*c*).

As shown in FIG. 9(*d*), silicon oxide or the like is grown on the glass substrate 201 by sputtering so as to cover the wiring patterns 220, thereby forming an insulating film 204.

Then, as shown in FIG. 9(*e*), a photoresist 205 is applied on the insulating film 204 and patterned by known photolithography, thereby forming, as shown in FIG. 9(*f*), a resist pattern 205 having grooves 221A, 62A, 63A, and 66A, and an openings (not shown). The grooves 221A are formed at predetermined positions corresponding to wiring lines which are to be formed; the grooves 62A and 63A, at positions of the strip lines 62 and 63, respectively; the groove 66A, at a predetermined position corresponding to the electrode 66; and the opening, at a position corresponding to a column portion (65A shown in FIG. 10(*l*)) of the support member 65 of the switch 17S.

As shown in FIG. 10(*g*), a metal film 206 made of, e.g., chromium or aluminum is formed by sputtering on the resist pattern 205 so as to bury the grooves 62A, 63A, 66A, and 221A and the opening.

The resist pattern 205 is removed by dissolving it in the organic solvent so that, as shown in FIG. 10(*h*), the wiring patterns 221 and the strip lines 62 and 63 of the switch 17S, the electrode 66, and the columnar electrode (not shown) of the support member 65 are simultaneously formed.

Next, as shown in FIG. 10(*i*), a metal film 209 made of gold or the like is selectively grown on the strip lines 62 and 63.

With this processing, the wiring resistance decreases to reduce the propagation loss in an RF band while an air gap is ensured between the contact 64 and the electrode 66 to avoid short-circuiting therebetween even if the contact 64 is displaced to a position where the strip lines 62 and 63 are electrically connected in a high-frequency manner.

As shown in FIG. 10(*j*), polyimide or the like is applied, dried, and harden on the entire surface of the substrate 201 to form a sacrificial layer 211 about 5 to 6 $\mu$m thick.

An opening (not shown) is formed at the position, where the column of the support member 65 of the switch 17S is to be formed, by known photolithography and etching to form a column portion made of a metal so as to fill the opening with it.

Then, as shown in FIG. 10(*k*), the arm portion of the support member 65 and the contact 64 are formed by lift-off at a position across the column portion and a portion above the strip lines 62 and 63.

With this processing, the arm portion of the support member 65 and the contact 64 are electrically connected to the column portion of the support member 65.

As shown in FIG. 10(*l*), only the sacrificial layer 211 is selectively removed by dry-etching using oxygen gas plasma.

With this processing, the aforementioned micromachine switch (switch 17S) (FIG. 8) and the wiring patterns 220 and 221 of the control signal lines 53 are simultaneously formed on the glass substrate 201, i.e., the phase control layer 35.

The above example has described the means for simultaneously forming the wiring patterns 220 and 221 and switch 17S on the glass substrate. However, the means for forming the circuit components of the phase shifter 17 of the present invention is not limited to this, and the switch 17S can be separately formed after forming the wiring patterns of the control signal lines 53 on the glass substrate in advance.

A ceramics board made of aluminum or the like or a semiconductor substrate can also be used in place of the glass substrate 201.

As described above, in the present invention, the circuit components of the phase shifter 17, the strip line 16, and the control signal lines 53 are simultaneously formed on a single surface of the phase control layer 35 in the single process by using a semiconductor device manufacturing process. This reduces the number of components to be individually mounted and the number of connections, thereby reducing the number of assembling processes. As a result, the manufacturing cost of the whole phased array antenna can be greatly reduced.

A method of mounting the switch 17S used in the phase shifter 17 will be described next with reference to FIG. 11.

In the present invention, the many switches 17S of the phase shifter 17 are simultaneously formed on the single substrate in the phase control layer 35 which is stacked in the multilayered structure.

Figure 11A:
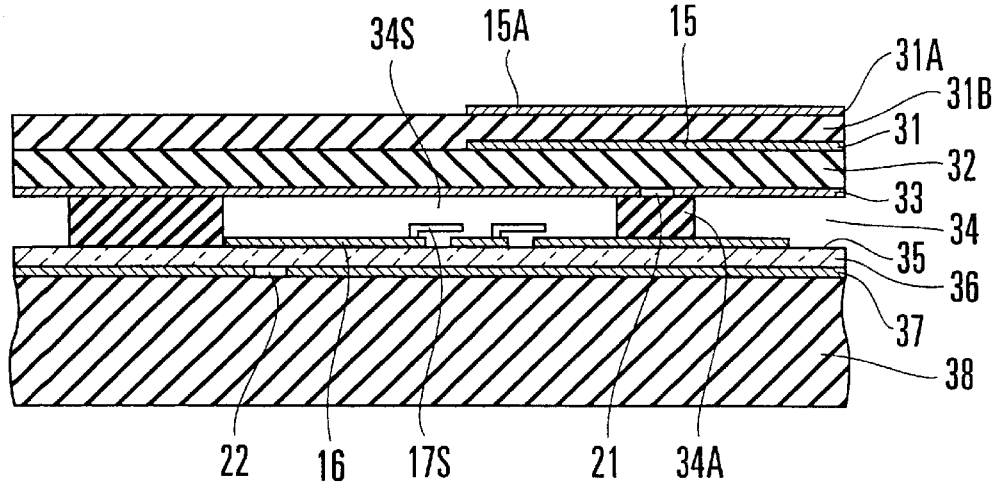
FIG. 11 shows views for explaining an example of mounting a switch.
Figure 11B:
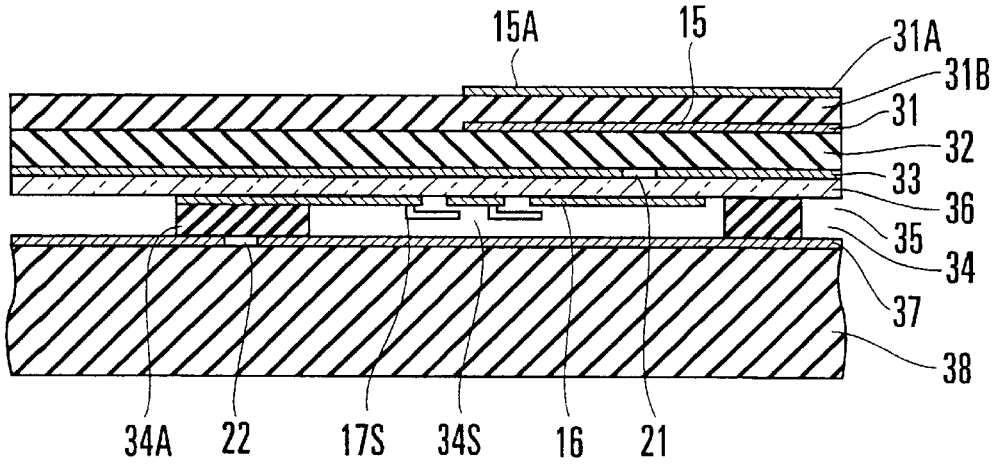

FIG. 11 shows views for explaining an example of mounting the switch 17S by exemplifying a case wherein a mounting space for the switch 17S is formed by a spacer serving as a separate component, in which FIG. 11(*a*) shows a case wherein a space is ensured above the switches 17S, and FIG. 11(*b*) shows a case wherein a space is ensured below the switches 17S.

In FIG. 11(*a*), the phase control layer 35 is formed on the dielectric layer 36, and the switches 17S used in the phase shifter 17 (micromachine switches in this case) is formed at once on the phase control layer 35.

As the dielectric layer 36, a semiconductor substrate (silicon, gallium arsenide, or the like) as well as the glass substrate (relative dielectric constant: about 4 to 8) can be used. Alternatively, a circuit board such as a ceramics board or a printed board may be used.

The thin film of the phase control layer 35 is formed by vacuum deposition or sputtering, and the pattern is formed by using a metal mask or photoetching.

As described above, when the switch 17S having a movable portion such as the contact 64 of the micromachine switch is used, a space for mounting the switch 17S need be ensured.

In this example, the mounting space has a space 34S (internal space) formed between the phase control layer 35 and coupling layer 33, and the space 34S is formed by forming a spacer 34A serving as a separate component.

In this case, the spacer 34A may be arranged below the coupling slot 21. With this arrangement, a space immediately under the coupling slot 21, which is generally an unused region, also serves as a region in which the spacer 34A is arranged, thereby reducing the area occupied by the spacer 34A.

As the spacer 34A, a material having high relative dielectric constant of about 5 to 30 such as alumina may be used and arranged under the coupling slot 21. Thus, the coupling slot 21 and the strip line 24 on the phase control layer 35 are efficiently coupled in a high-frequency manner.

Although not shown in FIG. 11, the spacer 34A may be formed from a conductor and arranged on the upper portion of a via hole (electrical connecting hole) separately formed in the dielectric layer 36, and may be electrically connected to ground patterns, e.g., the conductive patterns of the coupling layers 33 and 37.

In FIG. 11(*b*), as compared to FIG. 11(*a*) described above, the stacking order of the dielectric layer 36, phase control layer 35, and dielectric layer 34 is reversed.

More specifically, the upper side of the dielectric layer 36 closely contacts the coupling layer 33, the spacer 34A is formed between the phase control layer 35 on the lower side of the dielectric layer 36 and coupling layer 37, and the dielectric layer 34 is formed by the space 34S.

Therefore, the micromachine switch of the switch 17S has a shape enough to ensure a space 34S below the phase control layer 35.

Another method of mounting the switch 17S used in the phase shifter 17 will be described next with reference to FIG. 12.

Figure 12A:
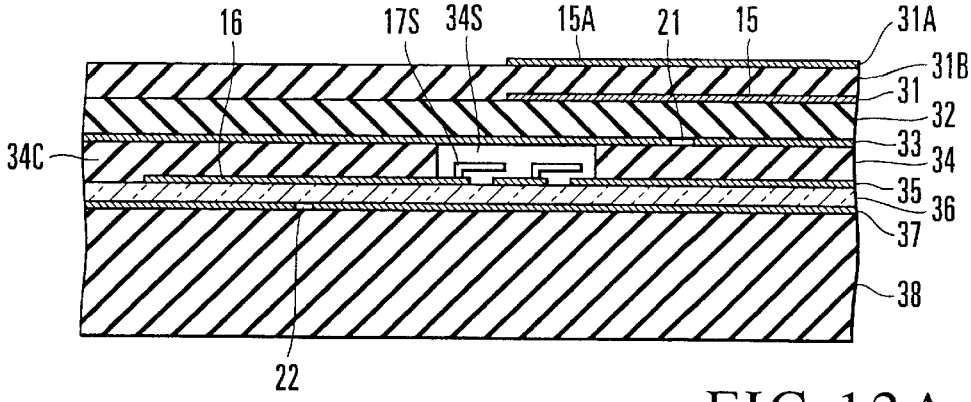
FIG. 12 shows views for explaining another example of mounting the switch.
Figure 12B:
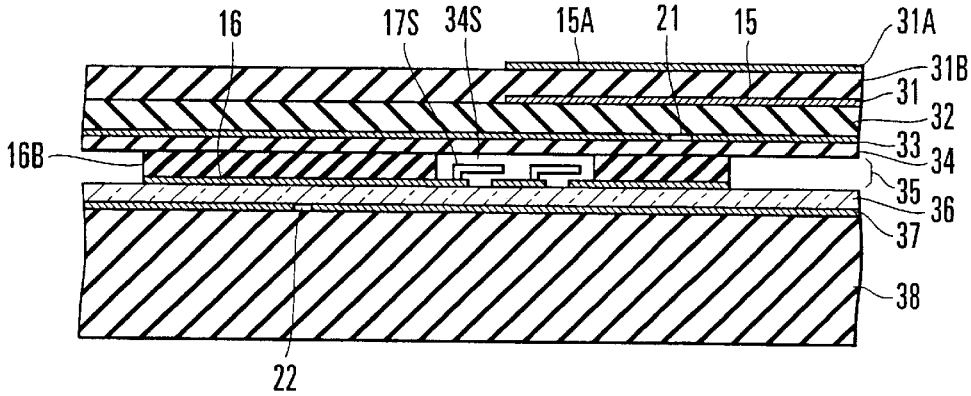
Figure 12C:
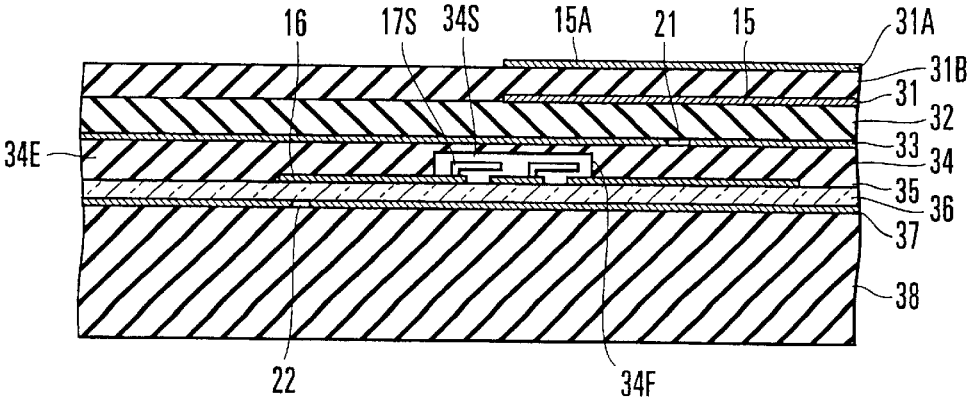

FIG. 12 shows views for explaining another example of mounting the switch 17S, in which a mounting space for the switch 17S is formed by various types of members.

FIG. 12(*a*) shows a case wherein the space 34S serving as the mounting space for the switch 17S is formed by a dielectric film 34C.

In this case, after a dielectric film is added on the sacrificial layer 211 used in forming the switch 17S, the additive dielectric film and a part of the sacrificial layer 211 are selectively removed, thereby forming the dielectric film 34C having a thickness larger than the height of the switch 17S.

By using a photosensitive adhesive as the dielectric film 34C, it can also serve as an adhesive in the sequential substrate stacking process.

As will be described later in Example 3, the dielectric film 34C may be made thin, and the height required for the dielectric layer 34 may be made up for a substrate 34D (not shown in FIG. 12).

FIG. 12(*b*) shows a case wherein the space 34S serving as the mounting space for the switch 17S is formed by forming the wiring pattern conductor on the phase control layer 35 thick. In this case, if the switch 17S has, e.g., the height of 7 $\mu$m as described above, the conductive may have the thickness of about 10 $\mu$m.

In a method of forming the wiring pattern conductor thick, the switch 17S is protected and plated thick with a metal by electrolytic plating or the like.

As the wiring pattern conductor, the strip line 16 having a relatively large width or a spacer-dedicated wiring pattern having a large area is used which is separately formed, thereby obtaining a stable mounting space 34S.

FIG. 12(*c*) shows a case wherein the space 34S serving as the mounting space for the switch 17S is formed by using a substrate 34E having a cavity (space) 34F.

In this case, the cavity 34F is formed in the substrate 34E so as to correspond to the position of the switch 17S mounted on the phase control layer 35.

The substrate 34E is stacked between the phase control layer 35 and coupling layer 33 as the dielectric layer 34.

As the substrate 34E, a dielectric substrate having a low dielectric constant (relative dielectric constant: about 1 to 4) or a high dielectric constant (relative dielectric constant: about 5 to 30) is used in accordance with the design condition.

The cavity 34F may be formed by cutting the surface of the substrate 34E by machining. Alternatively, the cavity 34F may be formed by forming a through hole by punching or the like.

After a photosensitive resin is applied on an organic substrate, the resin corresponding to the cavity 34F may be removed by exposing and developing processes. Various types of the formation methods are usable.

EXAMPLES

Examples 1 to 5 (examples of arrangements for each radiating element) will be described below with reference to FIGS. 13 to 17, in which the present invention is applied to a 30-GHz phased array antenna.

A case wherein a phase shifter 17 is made up of four phase shift circuits 17A to 17D having different phase shift amounts of 22.5°, 45°, 90°, and 180° will be described below.

Assuming that micromachine switches are used as the switching elements of the phase shift circuits 17A to 17D.

Example 1 will be described first with reference to FIG. 13.

Figure 13A:
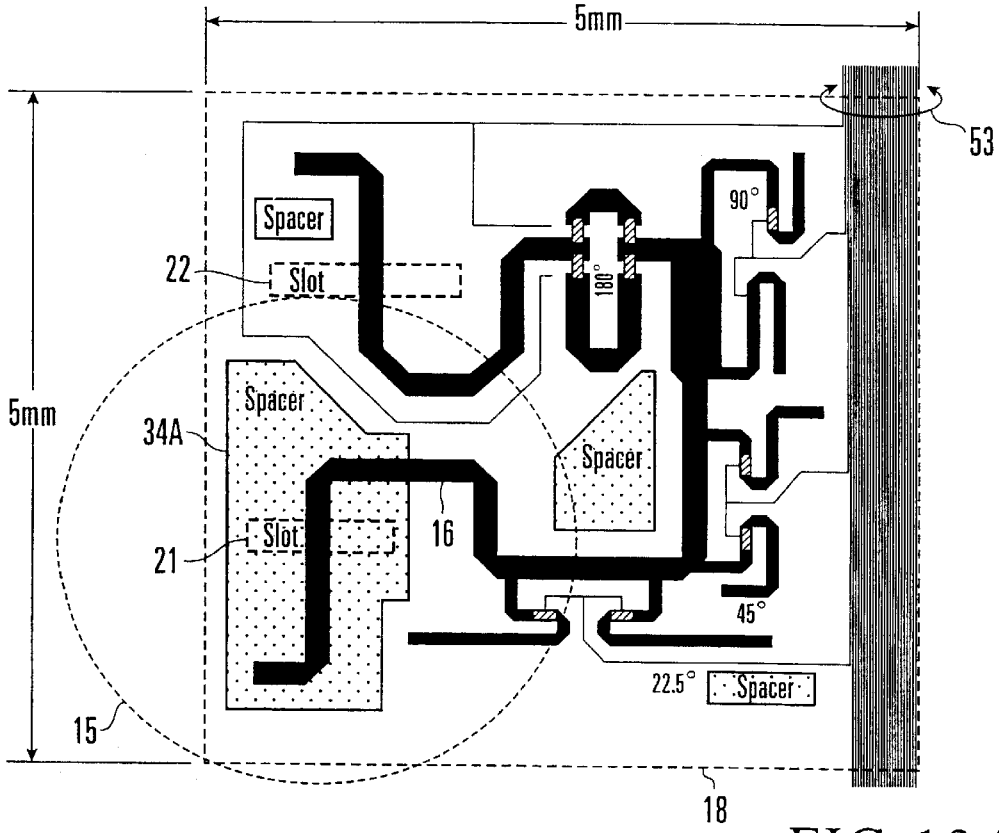
FIG. 13 shows views of the circuit arrangement in Example 1.
Figure 13B:
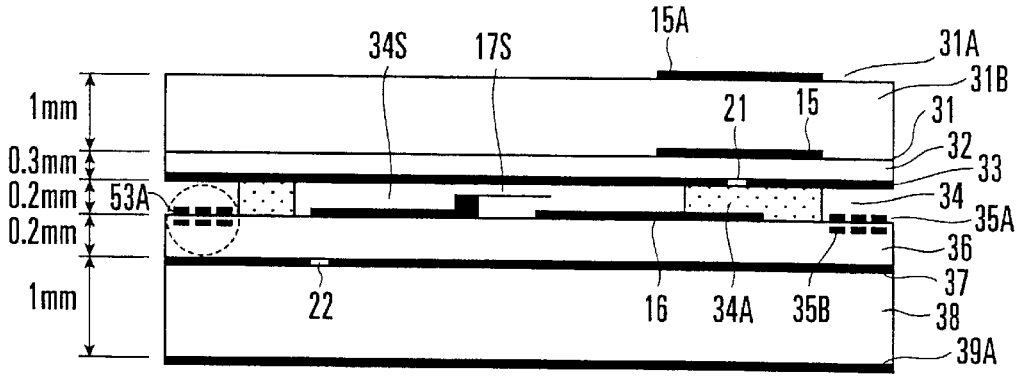
Figure 13C:
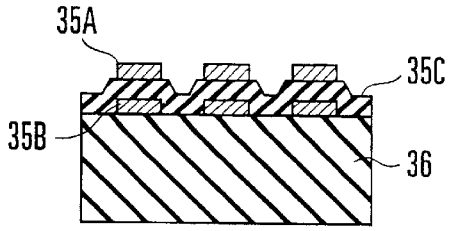

FIG. 13 shows views of a circuit arrangement of Example 1, in which FIG. 13(*a*) is a diagram showing a circuit arrangement in a phase shifter formation region, FIG. 13(*b*) is a schematic view showing a multilayered structure, and FIG. 13(*c*) is an enlarged view showing the arrangement of a control line layer portion 53A in a phase control layer 35.

A phase shifter formation region 18 is a region in which a phase shifter 17 arranged in correspondence with a radiating element 15 is formed on the phase control layer 35, which is a substantially square (5 mm×5 mm), as shown in FIG. 13(*a*).

In the phase shifter formation region 18, a strip line 16 is formed to connect the upper portion of a coupling slot 22 to the lower portion of a coupling slot 21.

Phase shift circuits for 22.5°, 45°, 90°, and 180° are arranged midway along the strip lines 16.

Control signal lines 53 extending from a driver unit 12 to each phase shifter 17 arrayed in a predetermined direction (the row direction in FIG. 7) are closely arranged on one side portion of the region 18, and are formed like a bundle.

Phase shifters 17A to 17D are simultaneously formed on one surface of a single substrate (glass substrate) as the phase control layer 35.

The circular radiating element 15 (broken narrow line shown in FIG. 13(*a*)) having a diameter of 2.5 mm to 4 mm is arranged on a radiating element layer 31 above the coupling slot 21.

FIG. 13(*b*) schematically shows the multilayered structure in Example 1, and the same reference numerals as in FIG. 11 denote the same parts.

Note that FIG. 13(*b*) schematically shows the multilayered structure, but does not show a specific section in FIG. 13(*a*).

The multilayered structure of this example is obtained by sequentially stacking from the bottom to top in FIG. 13(*b*), a ground layer 39A, a dielectric layer 38 (1 mm thick) in which a radial waveguide is formed, a ground layer 37, a dielectric layer 36 (0.2 mm thick), the phase control layer 35, a dielectric layer 34 (0.2 mm thick), a ground layer 33 in which the coupling slot 21 is formed, a dielectric layer 32 (0.3 mm thick), the radiating element layer 31, a dielectric layer 31B (1 mm thick), and a passive element layer 31A.

In this structure, the dielectric layer 34 between the phase control layer 35 and ground layer 33 has a space ensured by 0.2-mm thick spacers 34A, and switches 17S are formed at once on the phase control layer 35.

In this case, the spacer 34A may be arranged below the coupling slot 21. With this arrangement, a space immediately under the coupling slot 21, which generally an unused region, also serves as a region in which the spacer 34A is arranged, thereby reducing the area occupied by the spacer 34A.

In addition, if a material having high relative dielectric constant of about 5 to 30 such as alumina is used as the spacer 34A, the coupling slots 21 and the strip lines 16 on the phase control layer 35 are efficiently coupled in a high-frequency manner.

As shown in FIG. 13(*c*), the phase control layer 35 has a two-layered structure in which an insulating layer 35C is formed on the dielectric layer 36. The control signal lines 53 are separately wired on the layers 35A and 35B to connect the driver units 12 and the phase shift circuits 17A to 17D, respectively.

Assume that the following conditions are given:

the number of radiating elements (row×column): 72×72 elements wiring line width/wiring line interval (L/S): 4/4 $\mu$m In this case, when ½ phase shifters 17 on each row are controlled by the same driving unit 12, and control signal lines 58 equal in number to the layers 35A and 35B are to be formed, the width of the wiring bundle of the control signal lines 53 is given by:

8 $\mu$m×36 elements×4 bits/2 layers=0.58 mm

If the wiring line bundle has the width of around 0.58 mm, this wiring line bundle can be formed, within the region having 5 mm square, together with the 4-bit phase shifter coping with an RF signal having 30 GHz. For this reason, the interval between the radiating elements 15 can be set to 5 mm, thereby realizing the high-frequency (30 GHz) high-gain (36 dBi) phased array antenna without decreasing a beam scanning range.

Example 2 of the present invention will be described below with reference to FIG. 14.

Figure 14A:
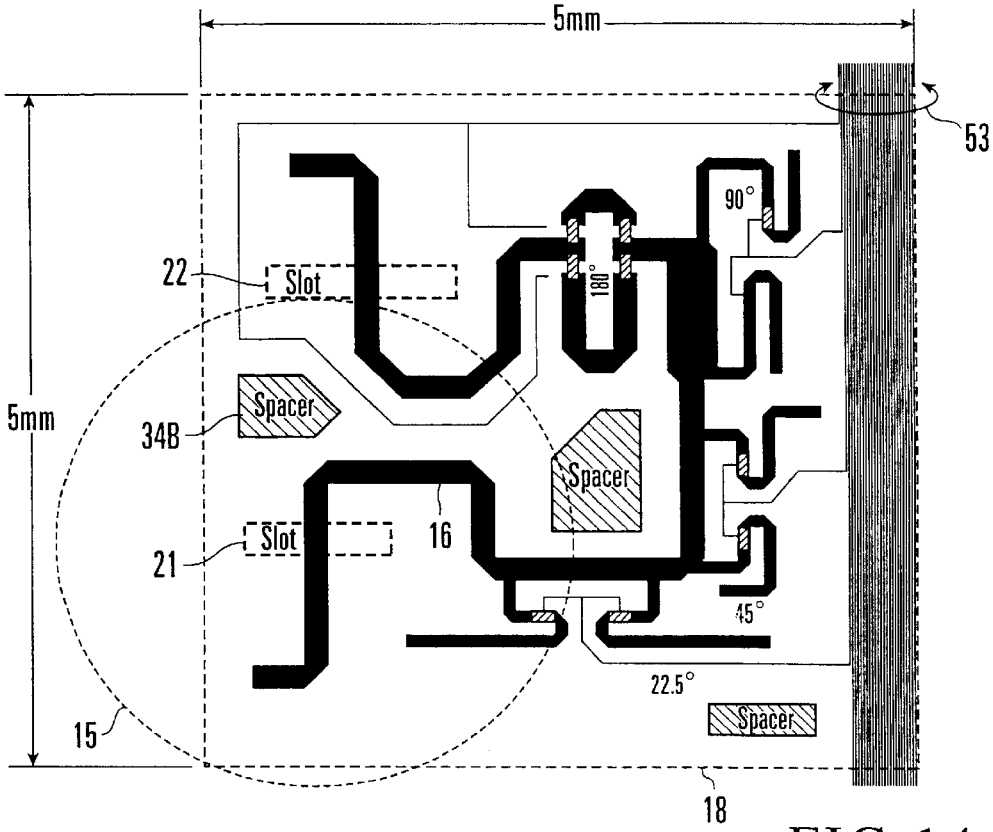
FIG. 14 shows views of the circuit arrangement in Example 2.
Figure 14B:
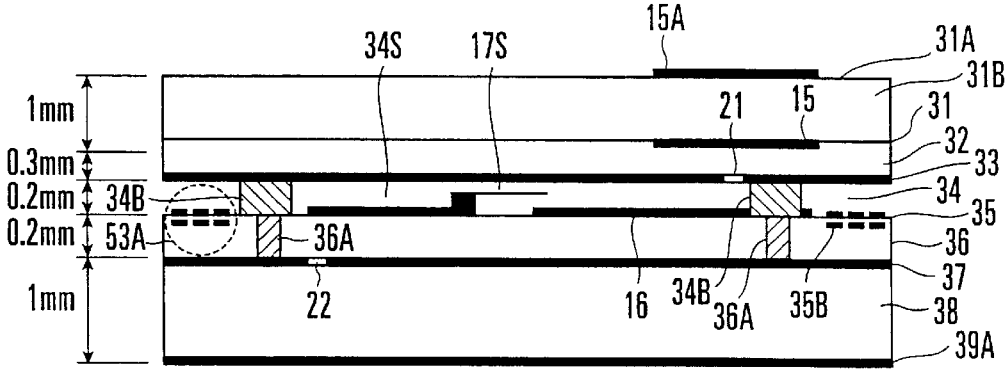
Figure 14C:
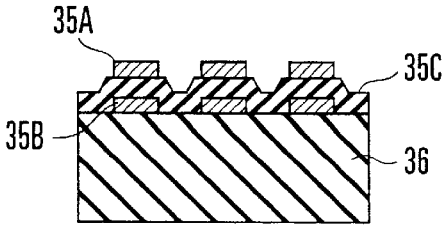

FIG. 14 shows views of a circuit arrangement of Example 2, in which FIG. 14(*a*) is a diagram showing a circuit arrangement in a phase shifter formation region, FIG. 14(*b*) is a schematic view showing a multilayered structure, and FIG. 14(*c*) is an enlarged view showing the arrangement of a control line layer portion 53A in a phase control layer 35.

In this example, as a spacer forming a dielectric layer 34, a spacer 34B made of a conductor is used in place of a spacer 34A having high dielectric constant.

In this case, the conductive spacer 34B is arranged at a position of a via hole (connection hole) 36A formed on the dielectric layer 36, in which ground patterns, e.g., ground patterns of a coupling layer 37 and a coupling layer 33 are electrically connected to each other.

With this structure, an inter-ground-plate unnecessary mode (a parallel-plate mode) can be suppressed without individually forming any means which couples ground potentials with each other.

Example 3 of the present invention will be described below with reference to FIG. 15.

Figure 15A:
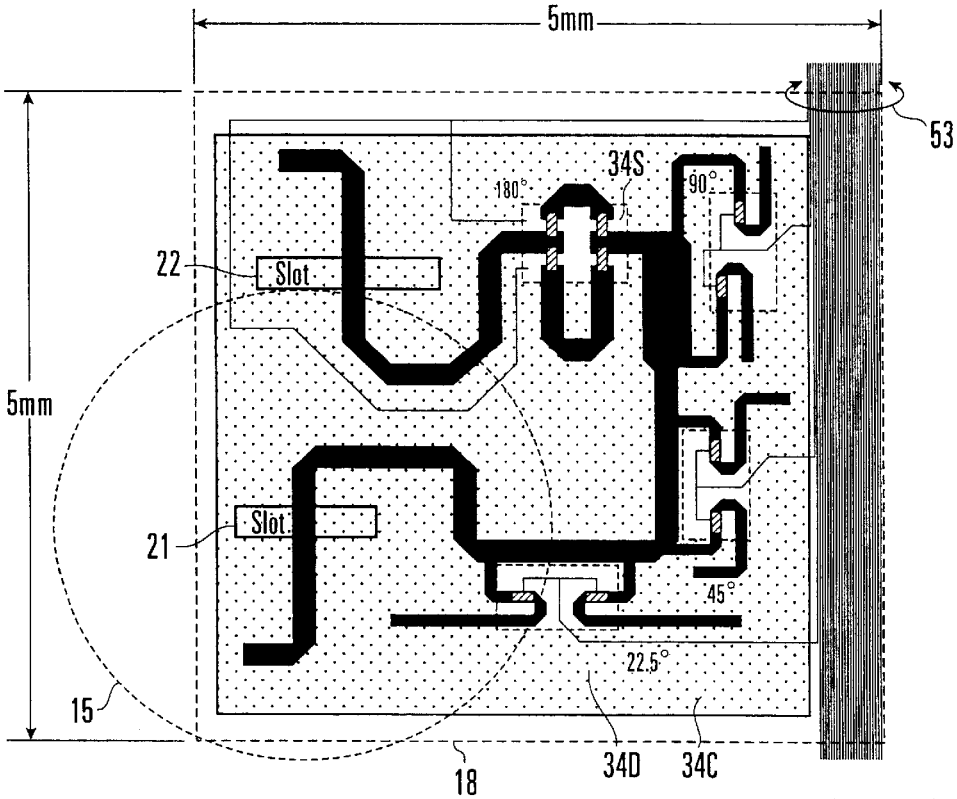
FIG. 15 shows views of the circuit arrangement in Example 3.
Figure 15B:
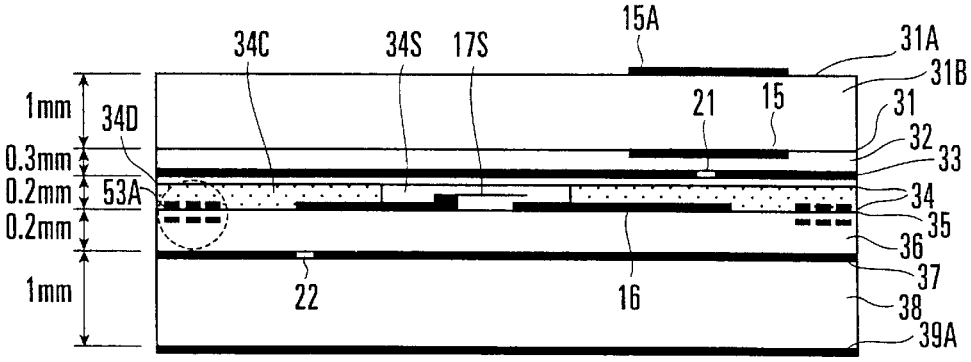
Figure 15C:
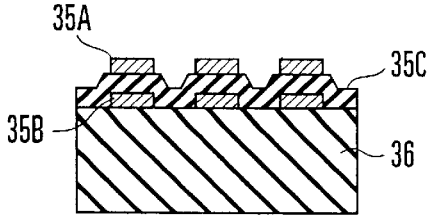

FIG. 15 shows views of a circuit arrangement of Example 3, in which FIG. 15(*a*) is a diagram showing a circuit arrangement in a phase shifter formation region, FIG. 15(*b*) is a schematic view showing a multilayered structure, and FIG. 15(*c*) is an enlarged view showing the arrangement of a control line layer portion 53A in a phase control layer 35.

In this structure, as shown in FIG. 12(*a*), a space serving as a mounting space for switches 17S is ensured by a dielectric film 34B.

In particular, a dielectric layer 34 is made up of only a dielectric film 34C in FIG. 12(*a*). In Example 3, a substrate 34D is inserted between the dielectric film 34C and a coupling layer 33.

When the necessary distance between the phase control layer 35 and the coupling layer 33 is considerably larger than the height of the switch 17S, a dielectric layer 34 portion above the height of the space for receiving the switch 17S is constructed by the substrate 34D.

Assuming that, for example, the dielectric layer 34 needs a thickness of 0.2 mm, and the switch 17*s* has the height of about 7 $\mu$m as described above. In this case, the dielectric layer 34C (e.g., a polyimide film) may have a thickness of about 10 $\mu$m, and the remaining height of 0.19 mm is compensated by the substrate 34D.

With this structure, the dielectric film 34C is suppressed thin, thereby easily forming the dielectric film 34C.

A dielectric (e.g., relative dielectric constant=5 to 30) is used as the substrate 34D so that an RF signal from a strip line 16 on the phase control layer 35 is efficiently coupled with a radiating element 15 via a coupling slot 21.

Example 4 of the present invention will be described below with reference to FIG. 16.

Figure 16A:
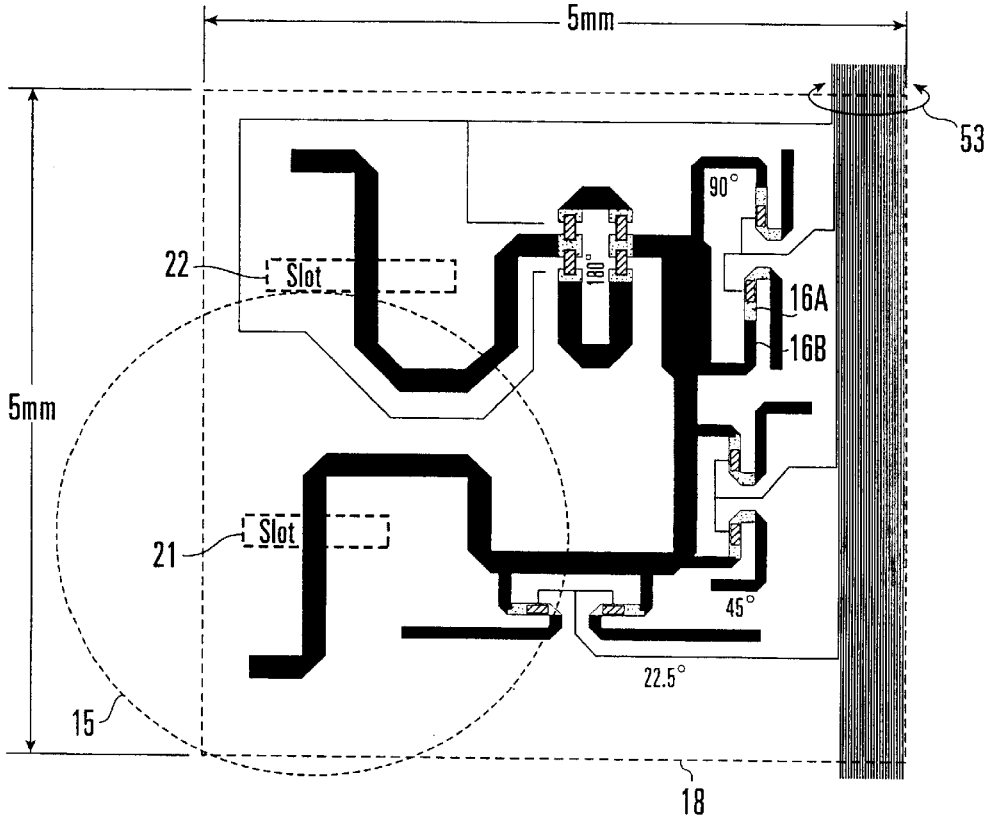
FIG. 16 shows views of the circuit arrangement in Example 4.
Figure 16B:
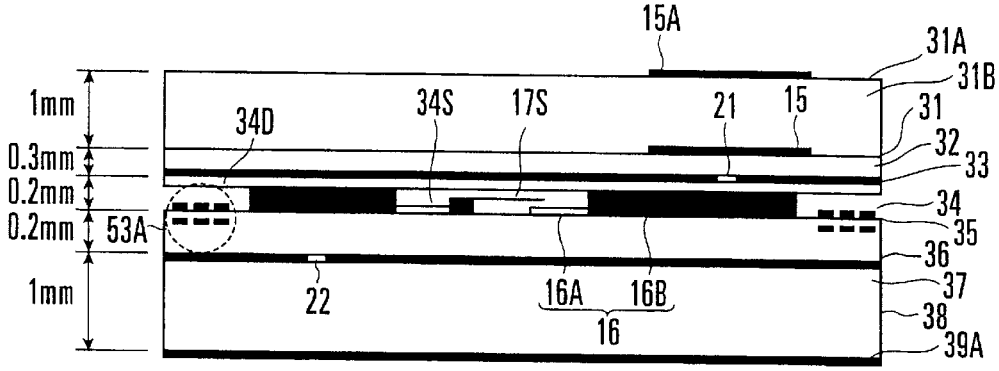
Figure 16C:
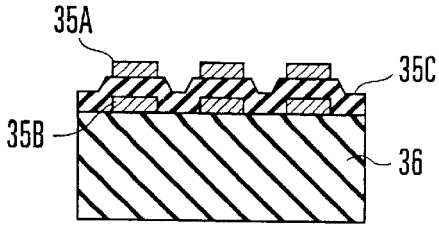

FIG. 16 shows views of a circuit arrangement of Example 4, in which FIG. 16(*a*) is a diagram showing a circuit arrangement in a phase shifter formation region, FIG. 16(*b*) is a schematic view showing a multilayered structure, and FIG. 16(*c*) is an enlarged view showing the arrangement of a control line layer portion 53A in a phase control layer 35.

In Example 4, as shown in FIG. 12(*b*), a space 34S serving as a mounting space for switches 17S is ensured by the thickness of the wiring pattern of the phase control layer 35.

In this structure, a wiring pattern 16B which is a part of a strip line 16 is formed by plating it thick to have a thickness larger than the height of the switch 17S.

A substrate 34D is inserted between the thick-film wiring pattern 16B and a coupling layer 33.

A material having a high dielectric constant (e.g., relative dielectric constant=5 to 30) is used as the substrate 34D so that an RF signal from the strip line 16 of the phase control layer 35 is efficiently coupled with a radiating element 15 via a coupling slot 21.

Example 5 of the present invention will be described below with reference to FIG. 17.

Figure 17A:
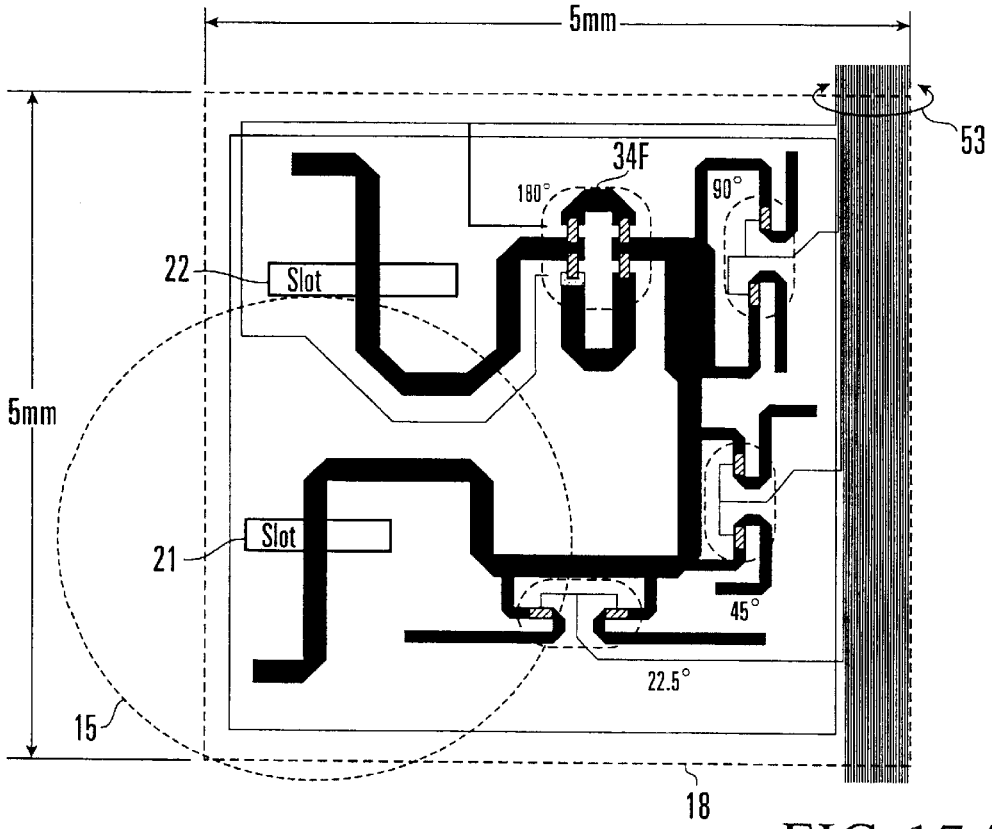
FIG. 17 shows views of the circuit arrangement in Example 5.
Figure 17B:
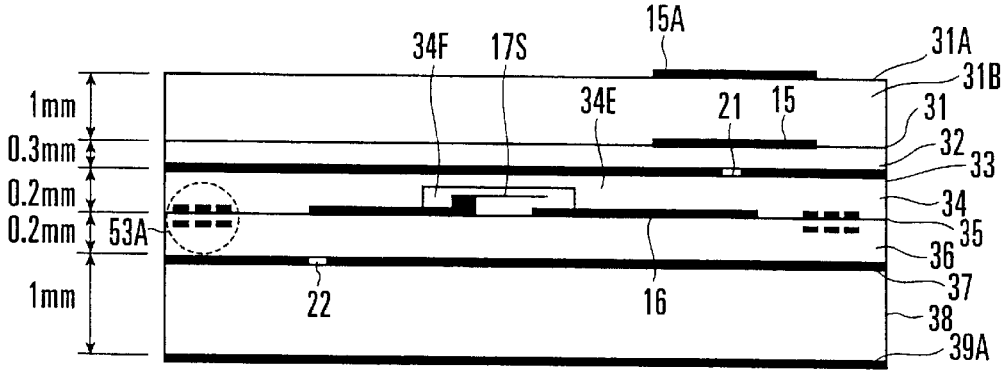
Figure 17C:
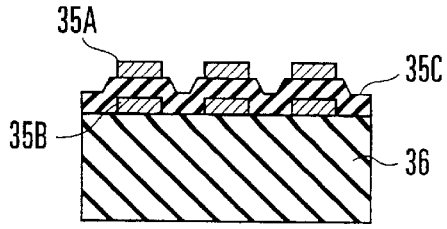
Figure 18:
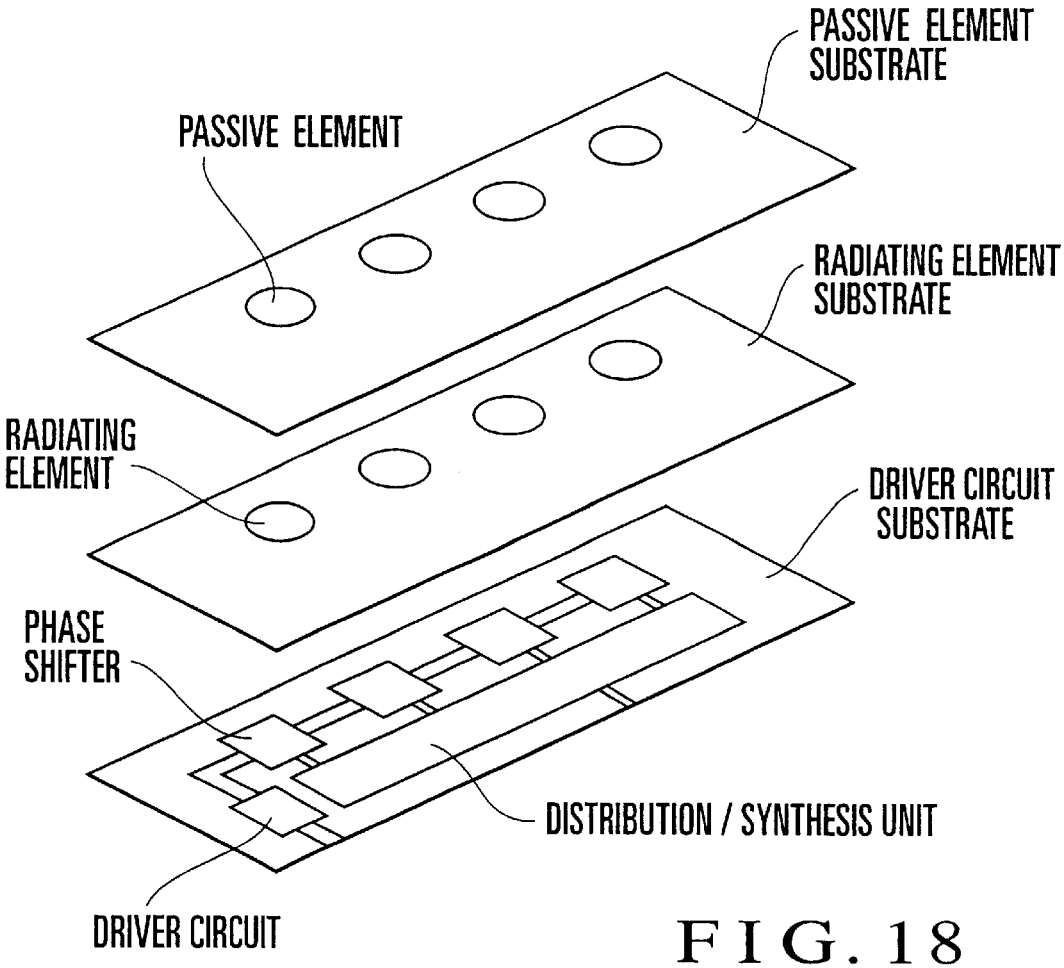
FIG. 18 PRIOR ART
FIG. 18 is a view for explaining a conventional phased array antenna.

FIG. 17 shows views of a circuit arrangement of Example 5, in which FIG. 17(*a*) is a diagram showing a circuit arrangement in a phase shifter formation region, FIG. 17(*b*)

is a schematic view showing a multilayered structure, and FIG. 17(*c*) is an enlarged view showing the arrangement of a control line layer portion 53A in a phase control layer 35.

In Example 5, as shown in FIG. 12(*c*), a space 34S serving as a mounting space for switches 17S is ensured by a substrate 34E having a cavity 34F.

In this structure, the cavity (space) 34F is formed at the position, in the substrate 34E, where the switch 17S is mounted on the phase control layer 35, and the switch 17S is housed in the cavity 34F when the substrates are tightly bonded.

A material having a high dielectric constant (e.g., relative dielectric constant=5 to 30) is used as the substrate 34E so that an RF signal from a strip line 16 of the phase control layer 35 is efficiently coupled with a radiating element 15 via a coupling slot 21.

As a method of forming the cavity 34F in the substrate 34E, machining in which the surface of the substrate 34E is cut using a router or in which a through hole is formed by punching may be used.

Alternatively, after a photosensitive resin is applied on an organic substrate, the resin corresponding to the cavity 34F may be removed by exposing and developing processes. Various types of the formation methods are usable.

Examples 1 to 5 have exemplified the case wherein the space 34S serving as a space in which the switch 17*s* is mounted is formed above the phase control layer 35. As in FIG. 11(*b*), however, the space 34S may be formed below the phase control layer 35.

As described above, the case wherein a radial waveguide is adopted as a distribution/synthesis unit 14 is described with reference to FIGS. 13 to 17. However, the form shown in FIG. 4, i.e., a distribution/synthesis layer 39 using the branch strip line may also be used.

In addition, as described above, the present invention can also be applied to a stacking order different from that in the examples in FIGS. 13 to 17. For example, the multilayered structure is obtained by sequentially stacking from the bottom to top, a phase control layer 35, dielectric layer 36, coupling layer 37, dielectric layer 38A, distribution/synthesis layer 39, dielectric layer 38, coupling layer 33, dielectric layer 32, and radiating element layer 31, and the distribution/synthesis layer 39 and the phase control layer 35 can also be arranged as innermost and outermost layers, respectively.

In this case, as a means for coupling RF signals between the layers in this structure, for example, a feed pin extending through a hole formed in the dielectric layer 37 may connect the phase control layer 35 to the distribution/synthesis layer 39 in a high-frequency manner, and a feed pin extending along the coupling layer 37 and coupling layer 33 may also connect the phase control layer 35 to a radiating element 15.

In this manner, the phase control layer 35 is arranged as the outermost layer so that the stacked structure can be obtained regardless of the height of a phase shifter 17.

In addition, as the form shown in FIG. 6, the radiation feeder 27 and the multilayered substrate unit 2 may be separately formed to use a space-fed system. By using this system, a layer functioning as the distribution/synthesis unit 14 (the distribution/synthesis layer 27 shown in FIG. 2 or the radial waveguide in Examples shown in FIGS. 13 to 17) can be excluded from the multilayered substrate unit 2.

INDUSTRIAL APPLICABILITY

The phased array antenna of the present invention is a high-gain antenna applicable to an RF band, and is effective for a satellite tracking on-vehicle antenna or satellite borne antenna used for satellite communication.

What is claimed is:

1. A phased array antenna used to transmit/receive an RF signal such as a microwave and milliwave to adjust a beam direction by controlling a phase of the RF signal transmitted/received by each radiation element, characterized by comprising a first multilayered structure made up of at least radiation element means on which a large number of radiation elements are arranged, and phase control means on which a large number of phase controllers for controlling the phase of the RF signal transmitted/received to/from each radiation element are mounted, wherein each phase controller includes a plurality of driver means for outputting control signals to give a predetermined phase shift amount for each radiating element and a plurality of phase shift means for receiving the control signals to control a phase of each radiating element, the phase shift means being simultaneously formed on a substrate of the phase control means, and the phase control means has an internal space having a predetermined height on an internal layer surface mounted with the phase controllers.

2. A phased array antenna according to claim 1, characterized in that said phased array antenna has a first coupling layer arranged between the phase control means and the radiating element means to couple the RF signals.

3. A phased array antenna used to transmit/receive an RF signal such as a microwave and milliwave to adjust a beam direction by controlling a phase of the RF signal transmitted/received by each radiation element, characterized by comprising a first multilayered structure in which phase control means on which each phase controller for controlling the phase of the RF signal transmitted/received to/from each radiating element is mounted, a first coupling layer for coupling the RF signals, radiating element means on which a large number of radiating elements are arranged, and a passive element layer are sequentially stacked, wherein each phase controller includes a plurality of driver means for outputting control signals to give a predetermined phase shift amount for each radiating element and a plurality of phase shift means for receiving the control signals to control a phase of each radiating element, the phase shift means being simultaneously formed on a substrate of the phase control means, and the phase control means has an internal space having a predetermined height on an internal layer surface mounted with the phase controllers.

4. A phased array antenna according to claim 1, characterized in that the phase control means has a second multilayered structure having a plurality of wiring layers.

5. A phased array antenna according to claim 3, characterized in that each dielectric layer is formed between the respective layers constructing said first multilayered structure.

6. A phased array antenna according to claim 1, characterized in that said phased array antenna further comprises a distribution/synthesis unit for distributing a transmission signal to each phase controller and synthesizing a reception signal from each phase controller.

7. A phased array antenna according to claim 1, characterized in that each phase shift means comprises a plurality of phase shift circuits for receiving outputs from the driver means and capable of making strip lines, each having a length corresponding to a different phase shift amount, switch by using RF switches.

8. A phased array antenna according to claim 1, characterized in that each driver means comprises a data distributor for receiving control data from a control unit to distribute the control data for predetermined radiating elements, and a plurality of phase controllers for latching and outputting outputs from the data distributor as the control signals on the basis of a trigger signal.

9. A phased array antenna according to claim 8, characterized in that the trigger signal is a pulse signal.

10. A phased array antenna according to claim 8, characterized in that the trigger signal is always output to the phase controller.

11. A phased array antenna according to claim 1, characterized in that the driver means uses a flip chip.

12. A phased array antenna according to claim 7, characterized in that the RF switch is comprised of a micromachine switch for electrically connecting/releasing a strip line to/from another strip line through a contact supported apart from the strip line by electrically or magnetically operating the contact.

13. A phased array antenna according to claim 1, characterized in that the radiating element is a patch or slot antenna.

14. A phased array antenna according to claim 6, characterized in that said distribution/synthesis unit is comprised of a distribution/synthesis layer having a branch circuit using a strip line or a radial waveguide using a metal enclosure with an internal space, and the distribution/synthesis layer is coupled to the phase control means via a second coupling layer.

15. A phased array antenna according to claim 6, characterized in that the distribution/synthesis unit is comprised of a primary radiation unit for performing space feeding.

16. A phased array antenna according to claim 2, characterized in that the first coupling layer couples layers by using a coupling slot or conductive feed pin.

17. A phased array antenna according to claim 14, characterized in that the second coupling layer couples layers by using a coupling slot or conductive feed pin.

18. A phased array antenna according to claim 5, characterized in that the dielectric layer is made of glass.

19. A phased array antenna according to claim 12, characterized in that the predetermined height is made larger than a maximum height of the contact from a bottom surface of the micromachine switch.

20. A phased array antenna according to claim 1, characterized in that the predetermined height is ensured by a dielectric spacer formed on the phase control means.

21. A phased array antenna according to claim 20, characterized in that said phased array antenna comprises a first coupling layer arranged between the phase control means and the radiating element means to couple the RF signals, and the dielectric spacer is formed below a coupling slot of the first coupling layer.

22. A phased array antenna according to claim 1, characterized in that the predetermined height is ensured by a conductive spacer formed on the phase control means.

23. A phased array antenna according to claim 10, characterized in that the predetermined height is ensured by a sacrificial layer used to form the micromachine switch and a dielectric film formed on the sacrificial layer.

24. A phased array antenna according to claim 19, characterized in that the predetermined height is ensured by forming thick a wiring pattern conductor except for a portion brought into contact with a contact of the micromachine switch.

25. A phased array antenna according to claim 1, characterized in that the predetermined height is ensured by a cavity formed by partially removing a dielectric layer formed on the phase control means.

26. A phased array antenna according to claim 1, characterized in that the driver means are arranged on two sides of the phase control means.

27. A method of manufacturing a phased array antenna used to transmit/receive an RF signal such as a microwave and milliwave to adjust a beam direction by controlling a phase of the RF signal transmitted/received by each radiation element, characterized by comprising the step of:

patterning, by photolithography and etching, at least radiating element means on which a large number of radiation elements are arranged and phase control means on which parts of phase controllers for controlling the phase of the RF signal transmitted/received to/from each radiation element are simultaneously formed, respectively;

stacking the patterned layers in a predetermined order; and bonding the stacked layers to each other.

28. A method of manufacturing a phased array antenna according to claim 27, characterized in that each phase controller includes a plurality of driver means for outputting control signals to give a predetermined phase shift amount for each radiating element and a plurality of phase shift means for receiving the control signals to control a phase shift of each radiating element.

29. A method of manufacturing a phased array antenna according to claim 28, characterized in that the driver means include a plurality of flip chips, and each phase shift means comprises a plurality of phase shift circuits for receiving outputs from the driver means and capable of making strip lines, each having a length corresponding to a different phase shift amount, switch by using RF switches.

30. A method of manufacturing a phased array antenna according to claim 29, characterized in that the RF switch is comprised of a micromachine switch for electrically connecting/releasing a strip line to/from another strip line through a contact supported apart from the strip line by electrically or magnetically operating the contact.

31. A method of manufacturing a phased array antenna according to claim 27, characterized in that the phase control means has the step of forming the strip lines of the micromachine switch and an electrode formed below the contact, the step of selectively growing an electrolytic-plating portion on the strip line, the step of forming a sacrificial layer, and the step of forming the contact on the sacrificial layer.

32. A method of manufacturing a phased array antenna according to claim 31, characterized in that the sacrificial layer is made of polyimide.

33. A method of manufacturing a phased array antenna according to claim 31, characterized in that the substrate is glass.

* * * * *